US009277615B2

(12) United States Patent
Sakai et al.

(10) Patent No.: US 9,277,615 B2
(45) Date of Patent: Mar. 1, 2016

(54) LED DRIVE CIRCUIT

(71) Applicants: CITIZEN HOLDINGS CO., LTD., Nishitokyo-shi, Tokyo (JP); CITIZEN ELECTRONICS CO., LTD., Fujiyoshida-shi, Yamanashi (JP)

(72) Inventors: Keisuke Sakai, Matsudo (JP); Takashi Akiyama, Sayama (JP); Satoshi Goto, Yamanashi (JP); Shigehisa Watanabe, Fujikawaguchiko-machi (JP); Tatsuro Yamada, Fujiyoshida (JP)

(73) Assignees: CITIZEN HOLDINGS CO., LTD., Tokyo (JP); CITIZEN ELECTRONICS CO., LTD., Yamanashi (JP)

( * ) Notice: Subject to any disclaimer, the term of this patent is extended or adjusted under 35 U.S.C. 154(b) by 0 days.

(21) Appl. No.: 14/768,366

(22) PCT Filed: Feb. 18, 2014

(86) PCT No.: PCT/JP2014/053787

§ 371 (c)(1),
(2) Date: Aug. 17, 2015

(87) PCT Pub. No.: WO2014/126258

PCT Pub. Date: Aug. 21, 2014

(65) Prior Publication Data

US 2015/0382420 A1 Dec. 31, 2015

(30) Foreign Application Priority Data

| | | |
|---|---|---|
| Feb. 18, 2013 | (JP) | 2013-028854 |
| Mar. 4, 2013 | (JP) | 2013-041683 |
| Mar. 8, 2013 | (JP) | 2013-046329 |
| Aug. 21, 2013 | (JP) | 2013-171090 |

(51) Int. Cl.
*H05B 33/08* (2006.01)
*H05B 41/282* (2006.01)

(52) U.S. Cl.
CPC ..... *H05B 33/0824* (2013.01); *H05B 33/0803* (2013.01); *H05B 41/2828* (2013.01)

(58) Field of Classification Search
USPC ..... 315/247, 224, 225, 185 S, 291, 307–326
See application file for complete search history.

(56) References Cited

U.S. PATENT DOCUMENTS

| | | | |
|---|---|---|---|
| 5,397,933 | A | 3/1995 | Yamada |
| 6,031,855 | A | 2/2000 | Watanabe |

(Continued)

FOREIGN PATENT DOCUMENTS

| | | |
|---|---|---|
| JP | 62273787 | 11/1987 |
| JP | 04115799 | 10/1992 |

(Continued)

OTHER PUBLICATIONS

International Search Report for International Application No. PCT/JP2014/053787 mailed Apr. 1, 2014.

(Continued)

*Primary Examiner* — Tuyet Vo
(74) *Attorney, Agent, or Firm* — RatnerPrestia

(57) ABSTRACT

The purpose of the present invention is to provide an LED drive circuit that is capable of ameliorating insufficient lighting and improving power utilization efficiency. This LED drive circuit is an LED drive circuit wherein the number of LEDs that are turned on varies in accordance with the voltage of a commercial alternating-current power supply, the LED drive circuit being characterized by having an LED row in which multiple LEDs are connected in series, a current detection resistor for detecting a current that flows in the LED row, a bypass circuit that is connected to an intermediate connection part of the LED row, and a current-limiting circuit that is connected to an end of the LED row, wherein the bypass circuit includes a first current-limiting component, the current-limiting circuit includes a second current-limiting component, the first current-limiting component is controlled on the basis of a voltage across the ends of the current detection resistor or a voltage that is obtained by dividing the voltage across the ends of the current detection resistor, and the second current-limiting component is controlled by the divided voltage that is obtained by dividing the current detection resistor.

12 Claims, 22 Drawing Sheets

(56) References Cited

U.S. PATENT DOCUMENTS

| | | | | |
|---|---|---|---|---|
| 8,294,379 | B2 | 10/2012 | Liu | |
| 8,937,433 | B1 * | 1/2015 | Wang | H05B 33/0824 315/122 |
| 2011/0199003 | A1 | 8/2011 | Muguruma | |
| 2011/0273102 | A1 | 11/2011 | vandeVen | |
| 2012/0139448 | A1 * | 6/2012 | Chiang | H05B 33/083 315/307 |
| 2012/0299492 | A1 | 11/2012 | Egawa | |

FOREIGN PATENT DOCUMENTS

| | | |
|---|---|---|
| JP | 0611364 | 2/1994 |
| JP | 06045674 | 2/1994 |
| JP | 06326384 | 11/1994 |
| JP | 09270555 | 10/1997 |
| JP | 10004213 | 1/1998 |
| JP | 2002190392 | 7/2002 |
| JP | 2004093657 | 3/2004 |
| JP | 2010225742 | 10/2010 |
| JP | 2011040701 | 2/2011 |
| JP | 2011103285 | 5/2011 |
| JP | 2013502081 | 1/2013 |
| WO | 2011096585 | 8/2011 |
| WO | 2011139624 | 11/2011 |
| WO | 2013011924 | 1/2013 |

OTHER PUBLICATIONS

International Preliminary Report on Patentability mailed Aug. 18, 2015 for International Application No. PCT/JP2014/053787.

* cited by examiner

LED DRIVE CIRCUIT

CROSS REFERENCE TO RELATED APPLICATIONS

This is the U.S. National Phase application of PCT/JP2014/053787, filed Feb. 18, 2014, which claims priority to Japanese Patent Application No. 2013-028854, filed Feb. 18, 2013, Japanese Patent Application No. 2013-041683, filed Mar. 4, 2013, Japanese Patent Application No. 2013-046329, filed Mar. 8, 2013, and Japanese Patent Application No. 2013-171090, filed Aug. 21, 2013, the disclosures of each of these applications being incorporated herein by reference in their entireties for all purposes.

FIELD OF THE INVENTION

The present invention relates to an LED drive circuit in which the number of LEDs driven to emit light varies according to a commercial AC power supply voltage.

BACKGROUND OF THE INVENTION

It is known to provide an LED drive circuit which drives LEDs to emit light by applying a full-wave rectified waveform obtained by full-wave rectifying a commercial AC power supply to an LED array constructed by connecting a plurality of LEDs in series. If such a full-wave rectified waveform is simply applied to the LED array, the LEDs do not light when the voltage of the full-wave rectified waveform is lower than the threshold voltage of the LED array, and as a result, the LEDs become dim and produce a perceivable flicker. To address this, there is proposed a drive method in which the number of LEDs driven to emit light in the LED array is varied according to the voltage of the full-wave rectified waveform.

For example, patent document 1 discloses an LED drive circuit which comprises a commercial AC power supply, a bridge rectifier, an LED array comprising three LED groups, a bypass circuit comprising an FET Q1, a bipolar transistor Q2, and resistors R2 and R3, and a current limiting resistor R1.

It is also known to provide a lighting apparatus which detects a power ON/OFF operation by a wall switch or the like and controls the light output in multiple levels according to the number of ON/OFF operations performed.

For example, patent document 2 discloses a lighting apparatus which changes the brightness of lighting when power is turned on within a predetermined time after power is turned off. This lighting apparatus comprises a lamp load (L), an inverter circuit (1), an inverter control circuit (4), a power off detection circuit (2), and a time judging circuit (3), and the time judging circuit (3) controls the light output as a whole.

In the lighting apparatus disclosed in patent document 2, the inverter circuit (1) causes the lamp load (L) to light. The inverter control circuit (4) controls the operation of the inverter circuit (1) and changes the state of lighting of the lamp load (L). The power off detection circuit (2) detects the power being turned off by a switch (SW1). The time judging circuit (3) judges the length of time during which the power is off by a power off time detection signal and, if the length of time is not longer than a predetermined length of time, then controls the inverter control circuit (4) to select the state of lighting of the lamp load (L). In this way, the lighting apparatus controls the light output based on the ON/OFF operation of the switch.

In recent years, LED lamps using LEDs as light sources are being widely used, and there has also developed a need to incorporate a light output control function in such LED lamps.

For example, patent document 3 discloses an LED lamp whose light output is controlled by the ON/OFF operation of a wall switch. The LED lamp comprises a bridge rectifier (102), a toggle detector (74), a sustain voltage supply circuit (71), a counter (96), and an LED lighting driver (80).

The bridge rectifier (102) supplies a DC voltage by rectifying the AC voltage applied via the wall switch (98). The toggle detector (74) monitors the toggle operation of the wall switch (98). The sustain voltage supply circuit (71) supplies a sustain voltage so that the state and function of the counter (96) can be maintained after the wall switch (98) is turned off. The counter (96) counts the number of toggle operations performed. If the wall switch (98) is turned on/off after a predetermined time interval has elapsed, the counter (96) ignores such a toggle operation.

The LED lamp disclosed in patent document 3 generates a stable DC voltage with reduced ripple, applies the DC voltage to the LED with a duty cycle determined by the count value of the counter (96), and thereby controls the light output of the LED (light output control by pulse-width modulation). However, this LED lamp requires the use of a high-voltage withstanding, large-capacitance electrolytic capacitor when generating the DC voltage. This electrolytic capacitor is not only large in size, but its lifetime is reduced when it is used in a high temperature environment as in the case of an LED lamp. Furthermore, the complexity of the construction tends to increase, because various circuits such as an oscillator circuit for pulse-width modulation have to be incorporated in the lamp.

When driving an LED array constructed by connecting a plurality of LEDs in series, it is often the practice to connect in series to the LED array a current limiting device or circuit for limiting the current flowing to the LED array. The simplest way is to employ a resistor as the current limiting device, but it may not be desirable because the value of the current flowing to the LED array varies according to the applied voltage. In view of this, there are cases where a constant-current device or circuit is used as the current limiting device or circuit. If a constant-current diode is used as the constant-current device, the circuit can be made simple, but the disadvantage is that the constant-current diode itself has to be changed as it becomes necessary to adjust the value of the current to be flown to the LED array.

For example, patent document 4 discloses one that uses a three-terminal regulator as a constant-current circuit. In the light-emitting device driving circuit disclosed in patent document 4, the constant-current circuit (10) is connected in series with a light-emitting circuit (LED array) (3*a*) containing light-emitting devices (LEDs) (2) and, within the constant-current circuit (10), the voltage at the current output end of a current detecting resistor is fed back to the three-terminal regulator.

For example, patent document 5 discloses a circuit in which a voltage divided between resistors (13) (current detecting resistors) connected in series with a current adjusting circuit (12) (three-terminal regulator) is fed back as a control signal to the current adjusting circuit (12) in order to minimize the variation of LED brightness while minimizing the limiting resistance and reducing the amount of heat generated.

FIG. 27 is a circuit diagram of a prior art LED drive circuit 400.

The circuit configuration can be simplified by using a depletion-mode FET instead of the above three-terminal regulator. In view of this, the LED drive circuit 400 which incorporates a constant-current circuit constructed from a combination of a depletion-mode FET and a resistor will be described with reference to FIG. 27.

In FIG. 27, the LED drive circuit 400 includes a bridge rectifier 401, an LED array 403, and the constant-current circuit 404. A commercial power supply 402 is connected to input terminals of the bridge rectifier 401. The bridge rectifier 401 is constructed from four diodes 401*a*, and has a terminal G for outputting a full-wave rectified waveform and a terminal H to which the current is returned. The LED array 403 is constructed by connecting a plurality of LEDs 403*a* in series; the anode of the LED array 403 is connected to the terminal G of the bridge rectifier 401 and the cathode is connected to the drain of the depletion-mode FET 405 contained in the constant-current circuit 404. The constant-current circuit 404 is constructed by combining the depletion-mode FET 405 with a current detecting resistor 406. One end of the current detecting resistor 406 is connected to the source of the depletion-mode FET 405, and the other end is connected to the gate of the depletion-mode FET 405 as well as to the terminal H of the bridge rectifier 401.

The drain-to-source current of the depletion-mode FET 405 is determined by the gate-to-source voltage. Assume that the drain-to-source current increases; then, since the source voltage with respect to the gate voltage increases due to the effect of the current detecting resistor 406, feedback is applied in a direction that constricts the current flowing through the depletion-mode FET 405. On the other hand, when it is assumed that the drain-to-source current decreases, since the source voltage drops, feedback is applied in a direction that increases the current. In this way, negative feedback is applied in the constant-current circuit 404 which thus operates in a constant current mode.

PATENT DOCUMENTS

Patent document 1: Tokuhyou (Published Japanese Translation of PCT application) No. 2013-502081

Patent document 2: Japanese Utility Patent Publication No. H04-115799

Patent document 3: Japanese Unexamined Patent Publication No. 2011-103285

Patent document 4: Japanese Utility Patent Publication No. H06-11364

Patent document 5: Japanese Unexamined Patent Publication No. 2004-93657

SUMMARY OF THE INVENTION

If it is desired to reduce the number of components and to enhance the operational stability of the LED drive circuit of patent document 1 while maintaining substantially the same functionality, the bypass circuit should be constructed from a combination of a depletion-mode FET and a resistor and that the current limiting resistor R1 be replaced by a constant-current circuit.

FIG. 25 is a circuit diagram for explaining a modified version of the LED drive circuit of patent document 1, and this modified circuit is not a known circuit.

The LED drive circuit 300 shown in FIG. 25 comprises a bridge rectifier 301 connected to a commercial AC power supply 302, LED sub-arrays 303 and 304, a bypass circuit 309*a*, and a constant-current circuit 309*b*. The LED array in the LED drive circuit 300 is constructed by connecting the LED sub-arrays 303 and 304 in series.

The bridge rectifier 301 is constructed from four diodes 301*a*, and its input terminals are connected to the commercial AC power supply 302. The bridge rectifier 301 outputs a full-wave rectified waveform from its terminal E, and the current returns to its terminal F. In the LED sub-array 303, a plurality of LEDs 303*a* are connected in series. Likewise, in the LED sub-array 304, a plurality of LEDs 304*a* are connected in series. The anode of the LED sub-array 303 is connected to the terminal E, and the cathode of the LED sub-array 303 is connected to the anode of the LED sub-array 304.

The bypass circuit 309*a* comprises a depletion-mode FET 305 and a resistor 307, and the drain of the FET 305 is connected to a connection node between the LED sub-array 303 and the LED sub-array 304. The source of the FET 305 is connected to the right-hand terminal of the resistor 307, and the gate of the FET 305 is connected to the left-hand terminal of the resistor 307 as well as to the terminal F. The constant-current circuit 309*b* comprises a depletion-mode FET 306 and a resistor 308, and the drain of the FET 306 is connected to the cathode of the LED sub-array 304. The source of the FET 306 is connected to the right-hand terminal of the resistor 308, and the gate of the FET 306 is connected to the left-hand terminal of the resistor 308 as well as to the source of the FET 305.

No current I flows when the voltage of the full-wave rectified waveform is not larger than the threshold voltage of the LED sub-array 303. When the voltage of the full-wave rectified waveform exceeds the threshold voltage of the LED sub-array 303 but is smaller than the sum of the threshold voltages of the LED sub-arrays 303 and 304, the current I flows through the LED sub-array 303 and thence through the bypass circuit 309*a*. During this period, the FET 305 operates in a constant current mode by feedback through the resistor 307 (hereinafter called the first constant current operation mode).

When the voltage of the full-wave rectified waveform further rises and exceeds the sum of the threshold voltages of the LED sub-arrays 303 and 304, the current also begins to flow through the LED sub-array 304. At this time, the voltage drop across the resistor 307 increases, so that the FET 305 is cut off, and the FET 306 operates in a constant current mode by feedback through the resistor 308 (hereinafter called the second constant current operation mode).

As described above, the LED drive circuit 300 provides three periods according to the voltage of the full-wave rectified waveform: the period during which all the LEDs 303*a* and 304*a* are OFF, the period during which only the LED sub-array 303 is ON, and the period during which both the LED sub-array 303 and the LED sub-array 304 are ON.

In the LED drive circuit 300 shown in FIG. 25, there also exists a period (voltage range) during which a transition is made from the first constant current operation mode to the second constant current operation mode. During this transition period, the current gradually increases due to the voltage drop across the current detecting resistor 308 contained in the constant-current circuit 309*b*. Since sufficient current cannot be supplied to the LED array during this transition period, the amount of light emission decreases, and the ratio of the amount of light emission to the supplied power (hereinafter called the power utilization efficiency) drops because of the heating of the resistor 308.

Accordingly, it is an object of the present invention to provide an LED drive circuit that can alleviate the problem of insufficient light emission and can improve the power utilization efficiency.

FIG. 26 is a circuit diagram of a circuit constructed by modifying the LED drive circuit 300 of FIG. 25 so as to be able to control the light output, and this modified circuit is not a known circuit.

In the LED drive circuit 300, the current I flowing through the LED array is determined by the amount of voltage drop across each of the resistors 307 and 308 and the characteristics of the FETs 305 and 306. This means that the light output can be controlled by adjusting the current flowing through the LED array by varying the values of the current detecting resistors 307 and 308. The LED drive circuit 310 shown in FIG. 26 is implemented based on this principle. In FIG. 26, the same elements and circuit blocks as those in FIG. 25 are designated by the same reference numerals, and will not be further described herein.

In FIG. 26, the LED drive circuit 310 comprises a bridge rectifier 301, LED sub-arrays 303 and 304, a bypass circuit 310*a*, a constant-current circuit 301*b*, and a control circuit 319. In FIG. 26, a wall switch 302*a* is also shown in conjunction with the commercial AC power supply 302 for convenience of explanation.

The bypass circuit 310*a* includes a depletion-mode FET 305, current detecting resistors 317*a* and 317*b*, and enhancement-mode FETs 317*c* and 317*d*. The right-hand terminal of the resistor 317*a* is connected to the source of the FET 317*c*, while the right-hand terminal of the resistor 317*b* is connected to the source of the FET 317*d*. The left-hand terminal of each of the resistors 317*a* and 317*b* is connected to the gate of the FET 305 as well as to the terminal F. The drain of each of the FETs 317*c* and 317*d* is connected to the source of the FET 305, the gate of the FET 317*c* is connected to a control signal 319*a* output from the control circuit 319, and the gate of the FET 317*d* is connected to a control signal 319*b* output from the control circuit 319.

The constant-current circuit 310*b* includes a depletion-mode FET 306, current detecting resistors 318*a* and 318*b*, and enhancement-mode FETs 318*c* and 318*d*. The right-hand terminal of the resistor 318*a* is connected to the source of the FET 318*c*, while the right-hand terminal of the resistor 318*b* is connected to the source of the FET 318*d*. The left-hand terminal of each of the resistors 318*a* and 318*b* is connected to the gate of the FET 306 as well as to the source of the FET 305. The drain of each of the FETs 318*c* and 318*d* is connected to the source of the FET 306, the gate of the FET 318*c* is connected to the control signal 319*a* output from the control circuit 319, and the gate of the FET 318*d* is connected to the control signal 319*b* output from the control circuit 319.

The terminals E and F as a power supply are connected to the control circuit 319. The control circuit 319 comprises a sustain voltage supply circuit which generates low-voltage stable DC power from the full-wave rectified waveform, a toggle detector for detecting the ON/OFF operation of the wall switch 302*a*, logic circuits including a decoder and a counter for counting an output signal of the toggle detector, and a level shifter which converts the output signal of the decoder to a voltage that can sufficiently turn on and off the FETs 317*c*, 317*d*, 318*c*, and 318*d*. Since the power consumption of the toggle detector, logic circuits, and level shifter can be made extremely low, the sustain voltage supply circuit can use a ceramic capacitor having a small capacitance. The control signals 319*a* and 319*b* are the output signals of the level shifter.

Each time the wall switch 302*a* is turned on, the state of the control signals 319*a* and 319*b* changes from one of three states "high and low", "low and "high", and "high and high" to another one of the three states. When the control signals 319*a* and 319*b* are high and low, respectively, the FETs 317*c* and 318*c* are turned on, and the FETs 317*d* and 318*d* are turned off. When the control signals 319*a* and 319*b* are low and high, respectively, the FETs 317*c* and 318*c* are turned off, and the FETs 317*d* and 318*d* are turned on. When the control signals 319*a* and 319*b* are both high, all the FETs 317*c*, 318*c*, 317*d*, and 318*d* are turned on.

When the resistance values of the resistors 317*a*, 317*b*, 318*a*, and 318*b* are denoted R317*a*, R317*b*, R318*a*, and R318*b*, respectively, the following relations hold: R317*a*>R318*a*, R317*b*>R318*b*, R317*a*>R317*b*, and R318*a*>R318*b*. Accordingly, when the control signals 319*a* and 319*b* are high and low, respectively, the circuit current I decreases to a minimum, so that the LED array emits dim light. When the control signals 319*a* and 319*b* are low and high, respectively, the circuit current I increases, and the LED array emits bright light. When the control signals 319*a* and 319*b* are both high, the circuit current I increases to a maximum, so that the LED array illuminates the brightest. In this way, each time the wall switch is turned on, the illumination state (brightness) of the LED drive circuit 310 is controlled, as described above.

In the LED drive circuit 310 of FIG. 26, the bypass circuit 310*a* has been described as including the resistors 317*a* and 317*b* for current detection and the FETs 317*c* and 317*d* as switching devices, and likewise, the constant-current circuit 310*b* has been described as including the resistors 318*a* and 318*b* for current detection and the FETs 318*c* and 318*d* as switching devices. However, the number of electronic components used in the LED drive circuit 310 is large, and furthermore, the amount of wiring for the switching devices which require control wiring lines imposes a burden. For example, in FIG. 26, the control signals 319*a* and 319*b* must be branched out for the FETs 317*c*, 317*d*, 318*c*, and 318*d*. Further, in the case of the FETs 318*c* and 318*d* contained in the constant-current circuit 310*b*, the "high" voltage of the control signals 319*a* and 319*b* to fully turn on the FETs must be increased, because the voltage drop due to the bypass circuit 310*a* has to be taken into account. This imposes limitations on the design of the level shifter incorporated in the control circuit 319.

Accordingly, it is an another object of the present invention to provide an LED drive circuit that can control the light output while reducing the number of components, especially, the number of switching devices, and while simplifying the circuit configuration.

In the LED drive circuit, since the temperature of the LEDs rises during light emission, it may be desired to incorporate a thermistor in the current limiting resistance in order to prevent excessive temperature rise. In this case, the current detecting resistance may be formed by combining a plurality of resistors, and one of the resistors may be replaced by a thermistor. However, since the current detecting resistance is usually on the order of tens of ohms, a thermistor having a small value has to be chosen. Furthermore, since a significant portion of the current responsible for the light emission of the LED array flows through the thermistor, its allowable current level must also be increased. That is, if temperature compensation is to be achieved by incorporating a thermistor in the current detecting resistance, the range of choice of thermistors is limited because of the limitations of the resistance value and the allowable current level.

Accordingly, it is an another object of the present invention to provide an LED drive circuit and a constant-current circuit wherein provisions are made to be able to effectively feedback control the current limiting device even when a thermistor is used that has a high resistance and a small allowable current value.

When all the components of the LED drive circuit 300 shown in FIG. 25 (excluding the bridge rectifier 11 and the commercial power supply 12) are mounted on a single module substrate, if the interconnect lines can only be formed on one side of the module substrate, there is no need to provide jumpers that straddle other interconnect lines. Geometrically, in the circuit diagram shown in FIG. 25, since there are no interconnect lines crossing each other, it can be understood that there is no need to provide jumpers.

On the other hand, in the LED drive circuit 10 shown in FIG. 1, the interconnect line connecting to the gate of the FET 16 crosses the interconnect line (hereinafter called the source interconnect line) connecting the sources of the FETs 15 and 16. This means that when all the components of the LED drive circuit 10 shown in FIG. 1 (excluding the bridge rectifier 11 and the commercial power supply 12) are mounted on a single module substrate, a jumper that straddles the source interconnect line has to be provided.

Jumpers are usually implemented by wires. However, since the wire easily deforms when subjected to pressure from above it, short-circuiting can easily occur between the wire and the source interconnect line. To prevent short-circuiting due to such deformation, an insulating film may be additionally formed on the portion of the source interconnect line over which the jumper is to be routed, or a component for jumper protection may be added. However, such measures for preventing short-circuiting due to deformation would add complexity to the fabrication process or lead to an increase in the number of components, resulting in an increase in the cost or the size of the LED module.

Accordingly, it is an another object of the present invention to provide an LED module that lends itself to compact design and that does not involve an increase in the number components or additional processing for insulation between the jumper wire and the source interconnect line, even when an LED array is mounted on a single module substrate along with a bypass circuit or current limiting circuit with provisions made to control the source-to-drain current of a depletion-mode FET in the bypass circuit or the like by a divided voltage obtained by voltage-dividing a current detecting resistor.

There is provided an LED drive circuit in which the number of LEDs driven to emit light varies according to a commercial AC power supply voltage, includes an LED array constructed by connecting a plurality of LEDs in series, a current detecting resistor for detecting a current flowing through the LED array, a bypass circuit connected to an intermediate connection point along the LED array, and a current limiting circuit connected to an end point of the LED array, wherein the bypass circuit includes a first current limiting device, and the current limiting circuit includes a second current limiting device, and wherein the first current limiting device is controlled based on a voltage developed across the current detecting resistor or a voltage obtained by dividing the voltage developed across the current detecting resistor, and the second current limiting device is controlled by a divided voltage obtained by voltage-dividing the current detecting resistor.

Preferably, the LED drive circuit further includes a second bypass circuit connected to another intermediate connection point along the LED array, and wherein the second bypass circuit includes a third current limiting device, and the third current limiting device is controlled by another divided voltage obtained by voltage-dividing the current detecting resistor.

Preferably, in the LED drive circuit, the first current limiting device and the second current limiting device are depletion-mode FETs.

Preferably, in the LED drive circuit, the bypass circuit or the current limiting circuit includes a voltage conversion circuit.

Preferably, in the LED drive circuit, the voltage conversion circuit controls the first current limiting device or the second current limiting device by converting the voltage developed across the current detecting resistor or the voltage obtained by dividing the developed voltage.

Preferably, in the LED drive circuit, the voltage conversion circuit includes a bipolar transistor, and the voltage developed across the current detecting resistor or the voltage obtained by dividing the developed voltage is input to an emitter of the bipolar transistor.

Preferably, in the LED drive circuit, the first current limiting device and the second current limiting device are enhancement-mode FETs.

Preferably, the LED drive circuit further includes a control circuit which causes a resistance value of the current detecting resistor to vary, and wherein light output control is performed by using the control circuit.

Preferably, the LED drive circuit further includes a plurality of series circuits each constructed by connecting a switching device and a resistor in series, and wherein the series circuits are connected in parallel with each other, and the control circuit causes the resistance value of the current detecting resistor to vary by controlling the switching device.

Preferably, in the LED drive circuit, the current detecting resistor is a device whose resistance value can be varied by a voltage applied to a control terminal.

There is also provided an LED drive circuit which performs light output control by adjusting a resistor for detecting a current flowing through an LED, includes an LED array constructed by connecting a plurality of LEDs in series, a bypass circuit connected to an intermediate connection point along the LED array, a constant-current circuit connected to an end point of the LED array, a current detecting resistor for detecting a current flowing through the LED array, a voltage dividing circuit connected in parallel with the current detecting resistor, and a control circuit which causes a resistance value of the current detecting resistor to vary, wherein the bypass circuit and the constant-current circuit each include a current limiting device, and the current limiting device is controlled by a voltage developed across the current detecting resistor or a voltage obtained by dividing the developed voltage.

There is also provided an LED drive circuit which performs light output control by adjusting a resistor for detecting a current flowing through an LED, includes an LED array constructed by connecting a plurality of LEDs in series, a plurality of bypass circuits each connected to one of a plurality of intermediate connection points along the LED array, a current detecting resistor for detecting a current flowing through the LED array, a voltage dividing circuit connected in parallel with the current detecting resistor, and a control circuit which causes a resistance value of the current detecting resistor to vary, wherein the plurality of bypass circuits each include a current limiting device, and the current limiting device is controlled by a voltage developed across the current detecting resistor or a voltage obtained by dividing the developed voltage.

Preferably, in the LED drive circuit, the current limiting device is a depletion-mode FET.

Preferably, in the LED drive circuit, the current limiting device is an enhancement-mode FET.

Preferably, in the LED drive circuit, the current detecting resistor includes a plurality of series circuits each constructed by connecting a switching device and a resistor in series, the series circuits are connected in parallel with each other, and the control circuit causes the resistance value of the current detecting resistor to vary by controlling the switching device.

Preferably, in the LED drive circuit, the switching device is an enhancement-mode FET.

Preferably, in the LED drive circuit, the current detecting resistor is a device whose resistance value can be varied by a voltage applied to a control terminal.

Preferably, in the LED drive circuit, the bypass circuit or the constant-current circuit includes a voltage conversion circuit.

Preferably, in the LED drive circuit, the voltage developed across the current detecting resistor or the voltage obtained by dividing the developed voltage is input to the voltage conversion circuit, and the voltage conversion circuit controls the current limiting device by converting the input voltage.

Preferably, in the LED drive circuit, the voltage conversion circuit includes a bipolar transistor, and the voltage developed across the current detecting resistor or the voltage obtained by dividing the developed voltage is input to an emitter of the bipolar transistor.

There is also provided an LED drive circuit which includes an LED array constructed by connecting a plurality of LEDs in series and a constant-current circuit connected in series with the LED array, wherein the constant-current circuit includes a current limiting device, a current detecting resistor, and a voltage dividing circuit including a thermistor, and wherein the voltage dividing circuit is connected in parallel with the current detecting resistor and outputs a divided voltage obtained by dividing a voltage developed across the current detecting resistor, and the current limiting device is controlled based on the divided voltage.

Preferably, in the LED drive circuit, the voltage dividing circuit includes a resistor connected in parallel or in series with the thermistor.

Preferably, in the LED drive circuit, the current limiting device is a depletion-mode FET.

Preferably, in the LED drive circuit, the current limiting device is an enhancement-mode FET.

There is also provided a constant-current circuit which includes a current limiting device, a current detecting resistor, and a voltage dividing circuit, wherein the voltage dividing circuit is connected in parallel with the current detecting resistor and outputs a divided voltage obtained by dividing a voltage developed across the current detecting resistor, and the current limiting device is controlled based on the divided voltage.

Preferably, in the constant-current circuit, the voltage dividing circuit includes a thermistor.

Preferably, in the constant-current circuit, the voltage dividing circuit includes a resistor connected in parallel or in series with the thermistor.

Preferably, in the constant-current circuit, the current limiting device is a depletion-mode FET.

Preferably, in the constant-current circuit, the current limiting device is an enhancement-mode FET.

There is also provided an LED module includes an LED array formed by connecting a plurality of LEDs in series on a module substrate, a depletion-mode FET forming a bypass circuit connected to an intermediate point along the LED array, a depletion-mode FET disposed either in another bypass circuit or in a current limiting circuit connected to an end point of the LED array, and a current detecting resistor for detecting a current flowing through the LED array, wherein a resistor for dividing a voltage developed across the current detecting resistor has a wire bonding pad on an upper surface thereof, and is disposed on an interconnect line connecting to a source of the depletion-mode FET.

Preferably, in the LED module, the current detecting resistor is formed from a resistor for dividing the voltage developed across the current detecting resistor.

Preferably, in the LED module, the current detecting resistor and the resistor for dividing the voltage developed across the current detecting resistor are connected in parallel with each other.

Preferably, in the LED module, the resistor for dividing the voltage developed across the current detecting resistor is provided with a high-voltage side wire bonding pad, a low-voltage side wire bonding pad, and a wire bonding pad for connecting to a gate of the depletion-mode FET.

Preferably, in the LED module, the resistor for dividing the voltage developed across the current detecting resistor is a network resistor which further includes a protection resistor between the low-voltage side wire bonding pad and the wire bonding pad for connecting to the gate of the depletion-mode FET.

Since every LED has a threshold voltage, if a current not greater than the threshold voltage is applied no current flows to the LED which therefore does not light. Similarly, an LED array constructed from a series connection of LEDs has a threshold voltage proportional to the number of LEDs in the series connection. In the LED drive circuit according to the present invention in which the number of LEDs driven to emit light varies according to the commercial AC power supply voltage, when the commercial AC power supply voltage is not higher than the threshold voltage of the LED array, if the voltage is higher than the threshold voltage of a predetermined number of series-connected LEDs contained in the section from the input end of the LED array to the first intermediate connection point, then the predetermined number of LEDs contained in that section of the LED array can be driven to emit light by flowing the current through the bypass circuit. When the commercial AC power supply voltage exceeds the threshold voltage of the series-connected LEDs contained in the section from the input end of the LED array to the next intermediate connection point or the end point of the LED array, the bypass circuit connected to the first intermediate connection point is gut off because of the action of the current limiting device contained in the bypass circuit. This current limiting device is controlled to cut off by the voltage developed across the current detecting resistor provided to detect the current flowing through the LED array or by a voltage obtained by dividing the developed voltage. The bypass circuit or current limiting circuit located at the subsequent stage is feedback-controlled by the voltage developed across the current detecting resistor or by a voltage obtained by dividing the developed voltage.

When there is more than one intermediate connection point along the LED array, the next intermediate connection point of the LED array is sequentially selected as the first intermediate connection point and the same control as described above is repeated during the period that the voltage of the full-wave rectified waveform rises. When the voltage of the full-wave rectified waveform falls, the process is reversed.

The LED drive circuit described above either comprises a bypass circuit connected to the intermediate connection point along the LED array and a current limiting circuit connected to the end point, or comprises a plurality of bypass circuits. Each bypass circuit or current limiting circuit includes a current limiting device, and each current limiting device is controlled by the voltage developed across the current detecting resistor or by a voltage obtained by dividing the developed voltage. That is, since the LED drive circuit can control each bypass circuit or current limiting circuit by using essentially one current detecting resistor, there is no need to provide one current detecting resistor for each bypass circuit or current limiting circuit as in the prior art LED drive circuit. This alleviates the problem of insufficient light emission due to the increase in current during the transition period that lasts until the bypass circuit or current limiting circuit begins to operate in a constant current mode; furthermore, since this serves to eliminate the power loss due to the insertion of a current detecting resistor for each circuit, the power utilization efficiency improves.

The LED drive circuit described above includes an LED array formed by connecting a plurality of LEDs in series, and applies a full-wave rectified waveform obtained from a commercial AC power supply to the LED array. A bypass circuit is connected to an intermediate connection point along the LED array. Either a constant-current circuit is connected to an end point of the LED array, or a plurality of bypass circuits are connected, one for one, to a plurality of intermediate connection points, or both such a constant-current circuit and such a plurality of bypass circuits are provided. The LED drive circuit further includes a current detecting resistor for detecting the current flowing through the LED array and a voltage dividing circuit connected in parallel with the current detecting resistor. A control circuit causes the resistance value of the current detecting resistor to vary. The bypass circuit and the constant-current circuit each include a current limiting device. The current limiting device is controlled by the voltage developed across the current detecting resistor or by a voltage obtained by dividing the developed voltage.

The above LED drive circuit controls the current flowing to the bypass circuit or constant-current circuit by the voltage developed across the single current detecting resistor or by a voltage obtained by dividing the developed voltage. This eliminates the need to provide one separate current detecting resistor for each bypass circuit or constant-current circuit, and achieves a reduction in the number of components, especially, the number of switching devices, while simplifying the circuit configuration. Further, if one terminal of the current detecting resistor is connected to the ground level of the LED drive circuit, the voltage for controlling the value of the current detecting resistor can be reduced.

In the LED module, when a divided voltage obtained by voltage-dividing the current detecting resistor is applied to the gate of each depletion-mode FET to control the source-to-drain current of the depletion-mode FET, at least one voltage dividing resistor for dividing the voltage developed across the current detecting resistor is placed on a common interconnect line to which the sources of the respective depletion-mode FETs are connected. The voltage dividing resistor is connected to the high-voltage side and low-voltage side interconnect lines via wires and also connected by a wire to the gate or the interconnect line connecting to the gate of the depletion-mode FET. This eliminates the need to route the interconnect line connecting to the gate of the depletion-mode FET by using a wire so as to run over the common interconnect line to which the source of the depletion-mode FET is connected. That is, there is no need to make a jumper connection using a wire.

In the above LED module, if the divided voltage obtained by voltage-dividing the current detecting resistor is used to control the source-to-drain current of the depletion-mode FET, since the voltage dividing resistor is placed on the common interconnect line (source interconnect line) to which the source is connected, there is no need to use a wire that has to be routed running over the source interconnect line. This eliminates the need for additional processing for insulation for the common source interconnect line; furthermore, since the voltage dividing resistor also serves as a relay chip for wiring bonding, the number of components does not increase, and thus the LED module can be a compact design.

DETAILED DESCRIPTION OF EMBODIMENTS OF THE INVENTION

Figure 1:
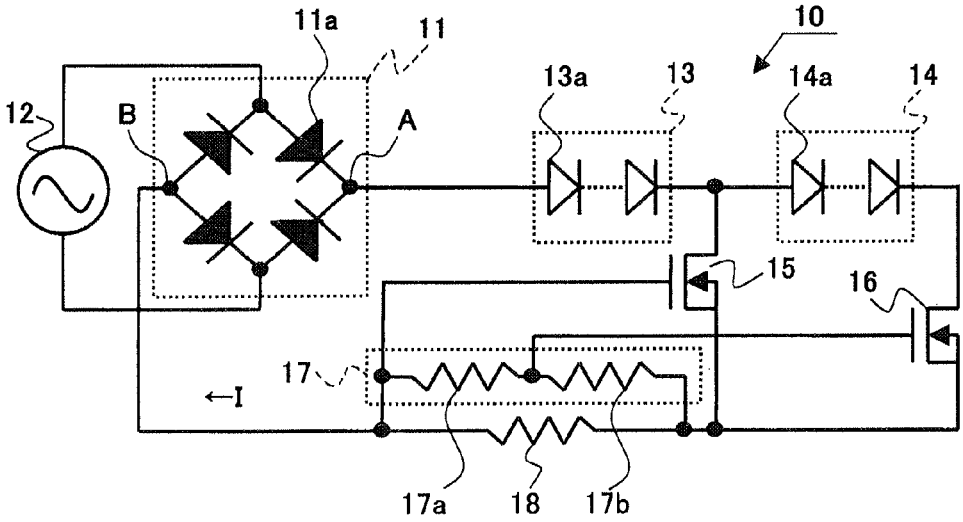
FIG. 1 is a circuit diagram of an LED drive circuit 10.

Preferred embodiments of the present invention will be described below with reference to the accompanying drawings. It will, however, be noted that the technical scope of the present invention is not limited by any particular embodiment described herein but extends to the inventions described in the appended claims and their equivalents. Further, in the description of the drawings, the same or corresponding component elements are designated by the same reference numerals, and the description of such component elements, once given, will not be repeated thereafter. It will also be noted that the scale to which each component element is drawn is changed as needed for illustrative purposes.

FIG. 1 is a circuit diagram of an LED drive circuit 10.

In FIG. 1, the LED drive circuit 10 comprises a bridge rectifier 11, LED sub-arrays 13 and 14, an FET 15 which is a bypass circuit as well as a current limiting device, an FET 16 which is a current limiting circuit as well as a current limiting device, a voltage dividing circuit 17, and a current detecting resistor 18. The LED array in the LED drive circuit 10 is formed by connecting the LED sub-arrays 13 and 14 in series. For convenience of explanation, a commercial AC power supply 12 is also shown.

In FIG. 1, the commercial power supply 12 is connected to input terminals of the bridge rectifier 11. The bridge rectifier 11 is constructed from four diodes 11*a*, and has a terminal A for outputting a full-wave rectified waveform and a terminal B to which current I is returned. The LED sub-arrays 13 and 14 are each constructed by connecting a plurality of LEDs 13*a* or 14*a* in series, and the anode of the LED sub-array 13 is connected to the terminal A of the bridge rectifier 11, while the cathode of the LED sub-array 13 is connected to the anode of the LED sub-array 14. Since the forward voltage of each of the LEDs 13*a* and 14*a* is about 3 V, it follows that when the rms value of the commercial AC power supply 12 is 230 V, a total of about 80 LEDs 13*a* and 14*a* are connected in series in the LED array.

The bypass circuit is constructed from the FET 15 (current limiting device) which is a depletion-mode FET, and the current limiting circuit is constructed from the FET 16 (current limiting device) which is also a depletion-mode FET. The drain of the FET 15 is connected to a connection node (intermediate connection point) between the LED sub-array 13 and the LED sub-array 14, the source is connected to the right-hand terminal of a resistor 17*b* and the right-hand terminal of the resistor 18, and the gate is connected to the left-hand terminal of a resistor 17*a* and the left-hand terminal of the resistor 18 as well as to the terminal B. The drain of the FET 16 is connected to the cathode of the LED sub-array 14 (the end point of the LED array), the source is connected to the source of the FET 15, and the gate is connected to a connection node between the resistors 17*a* and 17*b*.

The resistor 18 is the current detecting resistor, and its resistance value is on the order of tens of ohms. The resistors 17*a* and 17*b* are connected in series, and this series resistance is connected in parallel with the resistor 18. The resistors 17*a* and 17*b* each have a high resistance value (for example, on the order of tens to hundreds of kilo ohms), and together constitute the voltage dividing circuit 17 for dividing the voltage developed across the resistor 18.

Figure 2:
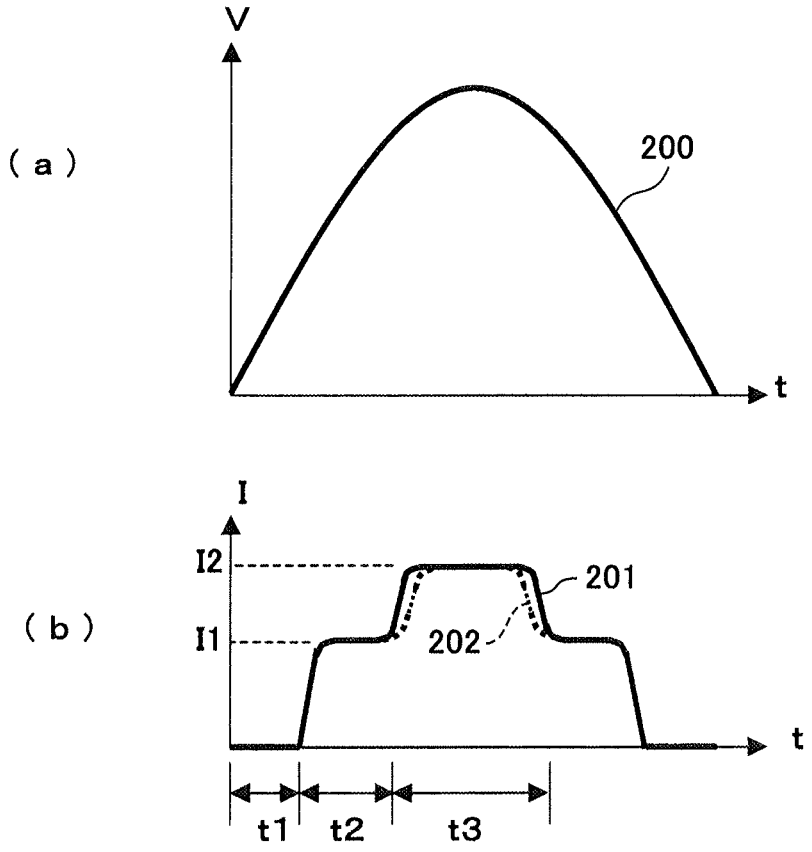
FIG. 2(*a*) is a diagram showing one period of a full-wave rectified waveform, and FIG. 2(*b*) is a diagram showing current I flowing in the LED drive circuit 10.

FIG. 2(*a*) is a diagram showing one period of the full-wave rectified waveform, and FIG. 2(*b*) is a diagram showing the current I flowing in the LED drive circuit 10.

Figure 25:
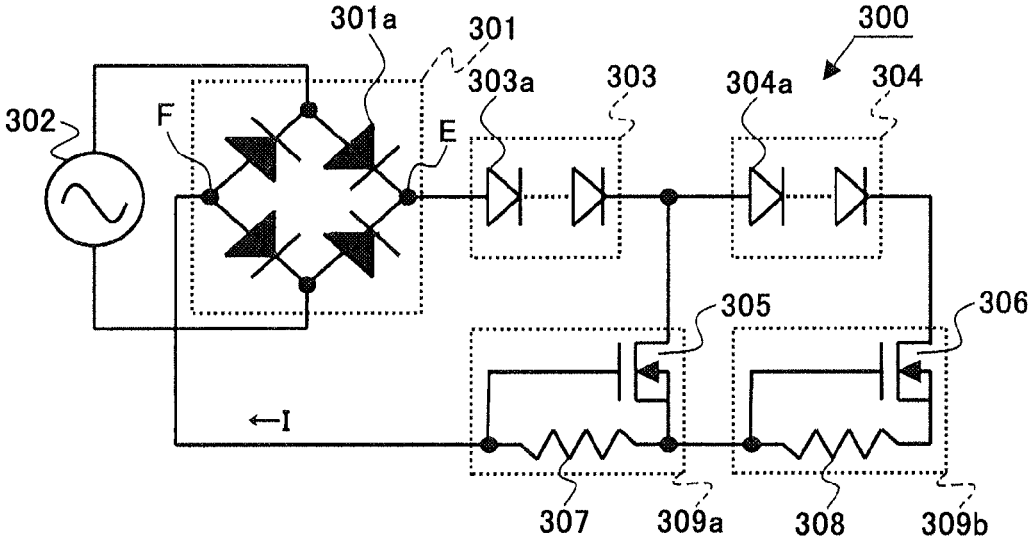
FIG. 25 is a circuit diagram for explaining a modified version of an LED drive circuit disclosed in patent document 1.

In FIGS. 2(*a*) and 2(*b*), the time t is plotted along the abscissa, and the same time axis is used for both figures. Curve 201 in FIG. 2(*b*) shows the current I flowing in the LED drive circuit 10, and a curve 202 shown by a dashed line in FIG. 2(*b*) indicates the portion of the current I in the LED drive circuit 300 of FIG. 25 that differs from the current I flowing in the LED drive circuit 10.

In FIG. 2(*b*), the current I is zero during the period t1 when the voltage of the full-wave rectified waveform (curve 200) shown in FIG. 2(*a*) is below the threshold voltage of the LED sub-array 13.

During the period t2 when the voltage of the full-wave rectified waveform exceeds the threshold voltage of the LED sub-array 13 but is smaller than the sum of the threshold voltages of the LED sub-arrays 13 and 14, the current I flows through the LED sub-array 13 and thence through the FET 15. During this period, the voltage drop across the resistor 18 is fed back as the gate voltage to the FET 15 which thus operates in a constant current mode (the first constant current operation mode).

When the voltage of the full-wave rectified waveform further rises, and exceeds the sum of the threshold voltages of the LED sub-arrays 13 and 14, that is, during the period t3, the current also flows through the LED sub-array 14. At this time, the voltage drop across the resistor 18 increases, so that the FET 15 is cut off. On the other hand, the voltage divided between the resistors 17*a* and 17*b* is fed back as the gate voltage to the FET 16 which thus operates in a constant current mode (the second constant current operation mode). The process that takes place during the period that the voltage of the full-wave rectified waveform falls is the reverse of the process that takes place during the period that the voltage of the full-wave rectified waveform rises.

During the period when a transition is made from the first constant current operation mode to the second constant current operation mode (hereinafter called the transition period), the current I increases as the full-wave rectified waveform rises. In the case of the dashed curve 202 (the LED drive circuit 300 of FIG. 25), the transition period is relatively long because of the presence of the resistor 308 in the path leading from the source of the FET 306 to the source of the FET 305. On the other hand, in the LED drive circuit 10 of FIG. 1, since no resistor is present in the path leading from the source of the FET 16 to the source of the FET 15, the transition period is short, and the current I quickly rises. As a result, in the LED drive circuit 10, the problem of insufficient light emission due to the increase in current during the transition period is alleviated, compared with the LED drive circuit 300. In the LED drive circuit 10, since there is no heating due to the resistor present in the LED drive circuit 300, and the energy that was consumed during the transition period is used for light emission, the power utilization efficiency improves.

The resistance value of the resistor 18 contained in the LED drive circuit 10 is the same as that of the resistor 307 contained in the LED drive circuit 300. As earlier described, in the LED drive circuit 10, no current flows to the LED sub-array 14 during the period t2 when the voltage of the commercial AC power supply 12 exceeds the threshold voltage of the LED sub-array 13 but is smaller than the sum of the threshold voltages of the LED sub-arrays 13 and 14. During this period, with the voltage produced by the voltage divider of the resistors 17*a* and 17*b*, the FET 16 as the current limiting device is neither in the ON state nor in the OFF state, nor is it in a stable state achieved by feedback. However, since no current flows to the LED sub-array 14, there will be no problem in whatever state the FET 16 is put. That is, the fact that the state of the FET 16 during the period t2 can be ignored contributes to simplifying the LED drive circuit 10.

Figure 3:
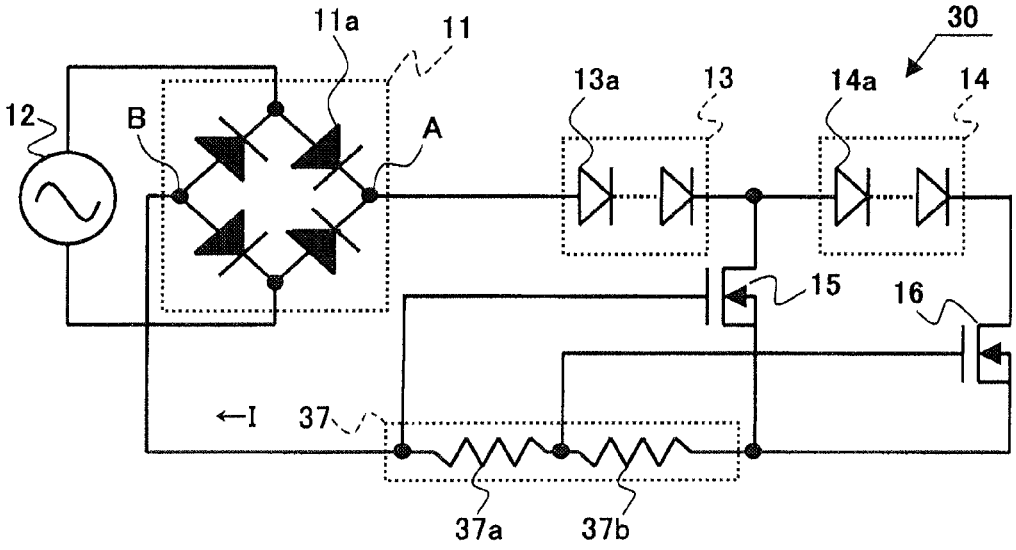
FIG. 3 is a circuit diagram of an alternative LED drive circuit 30.

FIG. 3 is a circuit diagram of an alternative LED drive circuit 30.

The LED drive circuit 10 shown in FIG. 1 has been described as comprising the current detecting resistor 18 separately from the voltage dividing resistors 17*a* and 17*b*. However, the same resistors may be used for both current detection and voltage division. The LED drive circuit 30 will be described below which uses the same resistors for both current detection and voltage division.

The only difference between the LED drive circuit 30 shown in FIG. 3 and the LED drive circuit 10 shown in FIG. 1 is that, in FIG. 3, the voltage dividing circuit 37 also serves as the current detection circuit. That is, the resistance value of the current detecting resistor 18 contained in the LED drive circuit 10 is equal to the combined resistance value of the resistors 37*a* and 37*b* contained in the LED drive circuit 30. Further, the ratio of the resistors 17*a* and 17*b* contained in the LED drive circuit 10 is equal to the ratio of the resistors 37*a* and 37*b* contained in the LED drive circuit 30. As a result, the current I flowing in the LED drive circuit 30 is substantially the same as the current I flowing in the LED drive circuit 10 shown by the curve 201 in FIG. 2. Accordingly, in the LED drive circuit 30, as in LED drive circuit 10, the amount of light emission increases, and the power utilization efficiency improves.

Figure 4:
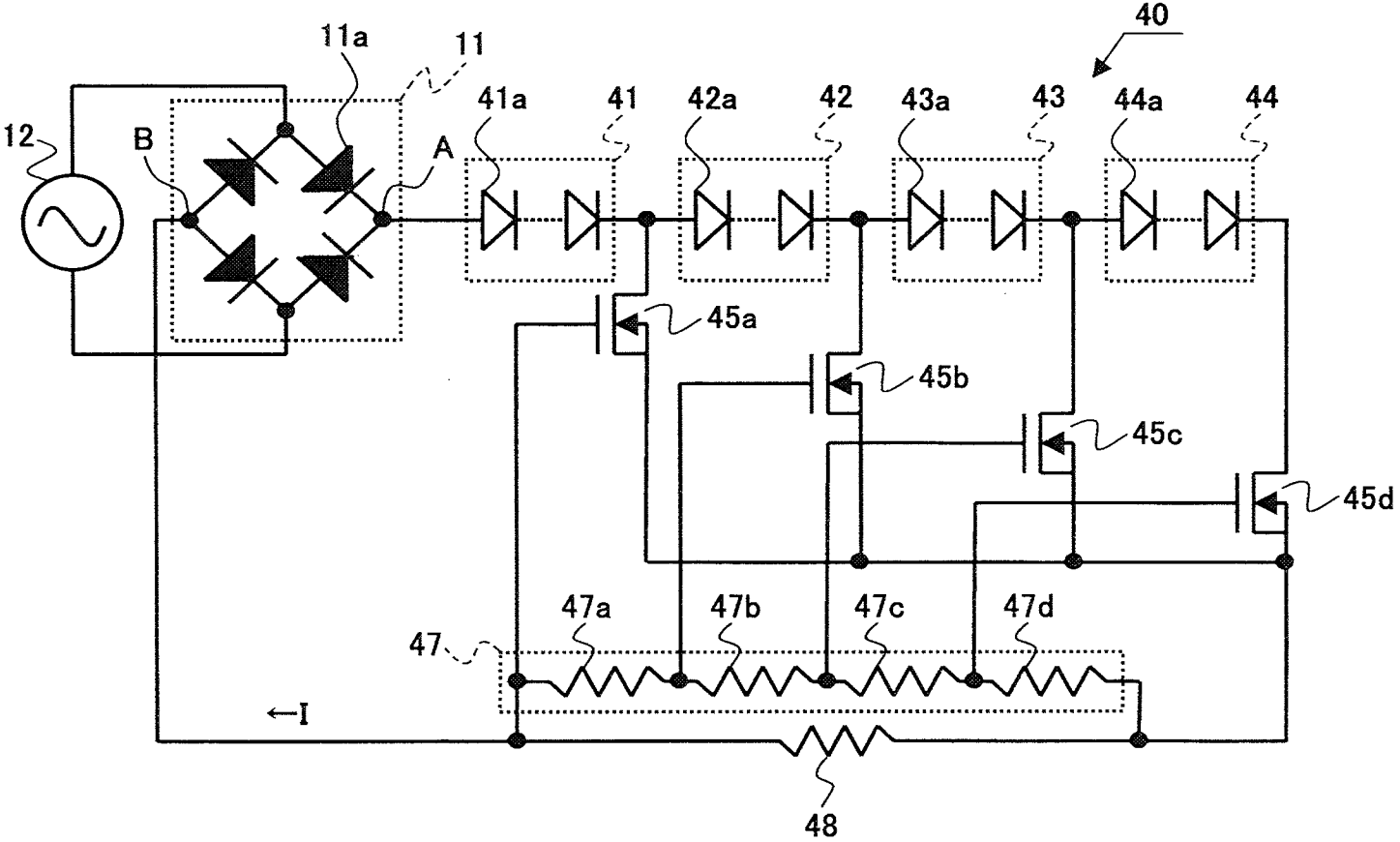
FIG. 4 is a circuit diagram of another alternative LED drive circuit 40.

FIG. 4 is a circuit diagram of another alternative LED drive circuit 40.

In the LED drive circuit 10 shown in FIG. 1, the LED array has been described as comprising two LED sub-arrays. However, the number of LED sub-arrays constituting the LED array need not be limited to two. In the LED drive circuit 40 shown in FIG. 4, the LED array is constructed using four LED sub-arrays.

The LED drive circuit 40 shown in FIG. 4 comprises a bridge rectifier 11, LED sub-arrays 41, 42, 43, and 44, FETs 45*a*, 45*b*, and 45*c* each of which is a bypass circuit as well as a current limiting device, an FET 45*d* which is a current limiting circuit as well as a current limiting device, a voltage dividing circuit 47, and a current detecting resistor 48. The LED array in the LED drive circuit 40 is formed by connecting the LED sub-arrays 41, 42, 43, and 44 in series. For convenience of explanation, a commercial AC power supply 12 is also shown.

In FIG. 4, the commercial AC power supply 12 and the bridge rectifier 11 are identical to those of the LED drive circuit 10 shown in FIG. 1. The LED sub-arrays 41, 42, 43, and 44 are each constructed by connecting a plurality of LEDs 41*a*, 42*a*, 43*a*, or 44*a* in series. The LED sub-arrays 41 to 44 are also connected in series. The anode of the LED sub-array 41 is connected to the terminal A of the bridge rectifier 11, and the connection nodes (intermediate connection points) between the respective LED sub-arrays 41, 42, 43, and 44 and the cathode of the LED sub-array 44 (the end point of the LED array) are respectively connected to the drains Of the FETs 45*a*, 45*b*, 45*c*, and 45*d*. Since the forward voltage of each of the LEDs 41*a*, 42*a*, 43*a*, and 44*a* is about 3 V, it follows that when the rms value of the commercial AC power supply 12 is 230 V, a total of about 80 LEDs 41*a*, 42*a*, 43*a*, and 44*a* are connected in series in the LED array.

Each bypass circuit comprises one of the depletion-mode FETs 45*a*, 45*b*, and 45*c* (current limiting devices), and there are three such bypass circuits. Likewise, the current limiting circuit comprises the depletion-mode FET 45*d* (current limiting device). The sources of the FETs 45*a*, 45*b*, 45*c*, and 45*d* are interconnected and are connected to the right-hand terminals of the resistors 47*d* and 48. The gate of the FET 45*a* is connected to the left-hand terminals of the resistors 47*a* and 48 as well as to the terminal B of the bridge rectifier 11. The gate of the FET 45*b* is connected to the connection node between the resistors 47*a* and 47*b*, the gate of the FET 45*c* is connected to the connection node between the resistors 47*b* and 47*c*, and the gate of the FET 45*d* is connected to the connection node between the resistors 47*c* and 47*d*.

The resistor 48 is the current detecting resistor, and its resistance value is on the order of tens of ohms. The resistors 47*a* to 47*d* are connected in series, and this series resistance is connected in parallel with the resistor 48. The resistors 47*a* to 47*d* each have a high resistance value (for example, on the order of tens to hundreds of kilo ohms), and together constitute the voltage dividing circuit 47 for dividing the voltage developed across the resistor 48.

In the LED drive circuit 40, as in the LED drive circuits 10 and 30 shown in FIGS. 1 and 3, respectively, the FETs 45*a* to 45*d* constituting the respective bypass circuits and the current limiting circuit are controlled by the voltage developed across the resistor 48 inserted for current detection and voltages obtained by tapping the voltage at intermediate points. In this way, the LED drive circuit 40 minimizes the power loss due to the insertion of the current detecting resistor, while increasing the amount of light emission. When the number of LED sub-arrays in the LED array is increased, the non-emission period t1 shown in FIG. 2(*b*) becomes shorter, and the number of steps in which the current varies increases, so that the current waveform becomes closer to a sinusoidal wave; as a result, the power factor and distortion factor both improve and the flicker decreases.

Since the current limiting circuit in the LED drive circuit 40 need not be turned off with respect to the voltage of the full-wave rectified waveform, a constant-current diode or a constant-current circuit of some other suitable configuration may be used instead of the FET 45*d*. In the LED drive circuit 40, a current limiting resistor may be used instead of the current limiting circuit. In the LED drive circuit 40, the current detecting resistor 48 may be divided so that it can also be used as the voltage dividing circuit, as in the voltage dividing circuit 37 shown in FIG. 3. In that case, the need for the voltage dividing circuit 47 can be eliminated.

Figure 5:
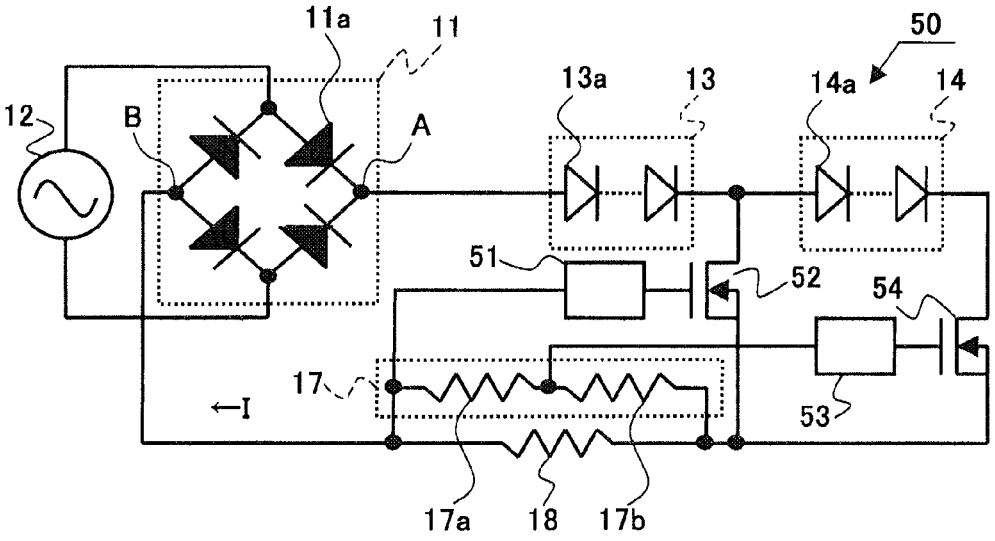
FIG. 5 is a circuit diagram of still another alternative LED drive circuit 50.

FIG. 5 is a circuit diagram of still another alternative LED drive circuit 50.

In the LED drive circuits 10, 30, and 40 shown in FIGS. 1, 3, and 4, respectively, a depletion-mode FET has been used as the current limiting device forming the bypass circuit or current limiting circuit. However, the current limiting device need not be limited to a depletion-mode FET, but use may be made of an enhancement-mode FET or a bipolar transistor. The LED drive circuit 50 described hereinafter uses an enhancement-mode FET as the current limiting device.

The LED drive circuit 50 differs from the LED drive circuit 10 shown in FIG. 1 in that, in FIG. 5, the bypass circuit is constructed from a combination of a voltage conversion circuit 51 and an enhancement-mode FET 52 and the current limiting circuit is constructed from a combination of a voltage conversion circuit 53 and an enhancement-mode FET 54.

A voltage from the left-hand terminal of the voltage dividing circuit 17 is input to the voltage conversion circuit 51, and a voltage divided through the voltage dividing circuit 17 is input to the voltage conversion circuit 53. Power supply, etc., not shown are also input to the voltage conversion circuits 51 and 53. The voltage conversion circuits 51 and 53 each include a constant voltage generating circuit and an adder circuit and, if necessary, further include a smoothing circuit, a voltage drop circuit, etc., in order to obtain a stable DC power supply.

As opposed to the depletion-mode FETs 15 and 16 (see FIG. 1) where the gate-to-source voltage that causes current to flow (the FET threshold voltage) has a negative value, the enhancement-mode FETs 52 and 54 have a positive threshold voltage. In each of the voltage conversion circuits 51 and 53, the voltage generated by the constant voltage generating circuit and the voltage obtained by voltage division are added together (or one is subtracted from the other), and the resulting voltage is used to control the current flowing to the FET 52 or 54. That is, negative feedback control of the FETs 52 and 54 and cutoff control of the FET 52 are performed in a manner similar to the bypass circuit (FET 15) and current limiting circuit (FET 16) shown in FIG. 1.

In the LED drive circuit 50, as in the LED drive circuits 10, 30, and 40 shown in FIGS. 1, 3, and 4, the FETs 52 and 54 constituting the bypass circuit and the current limiting circuit are respectively controlled by the voltage developed across the resistor 18 inserted for current detection and the voltage obtained by tapping the voltage at the intermediate point. In this way, the LED drive circuit 50 also minimizes the power loss due to the insertion of the current detecting resistor, while increasing the amount of light emission.

Figure 6:
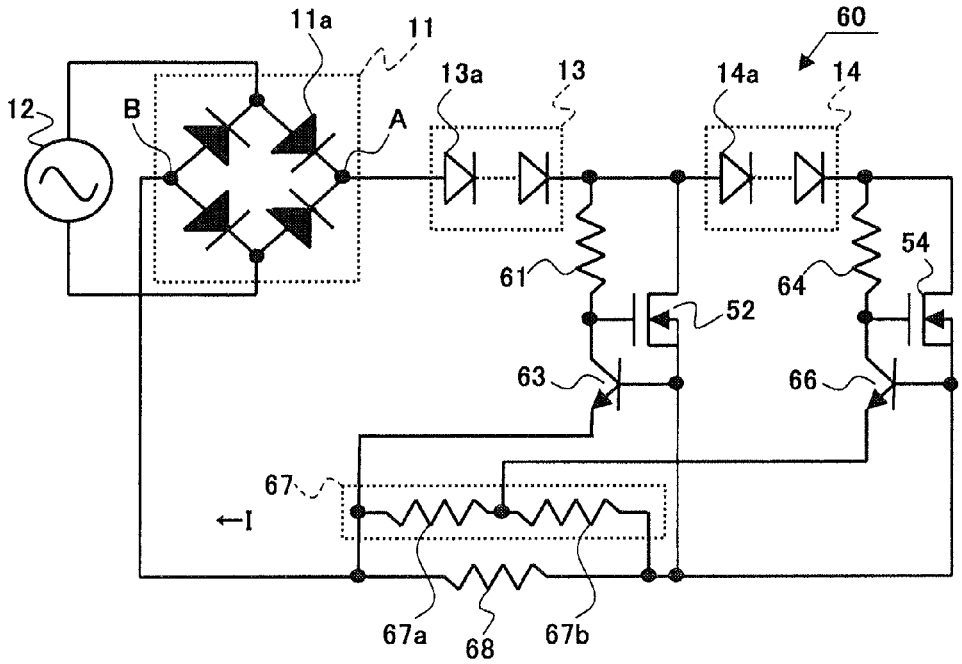
FIG. 6 is a circuit diagram of yet another alternative LED drive circuit 60.

FIG. 6 is a circuit diagram of yet another alternative LED drive circuit 60.

In the LED drive circuit 50 shown in FIG. 5, the voltage conversion circuit 51 has been described as including a constant voltage generating circuit and an adder circuit. However, the construction of the voltage conversion circuit can be simplified using a bipolar transistor. In the LED drive circuit 60 described hereinafter, the bypass circuit and the current limiting circuit each include a bipolar transistor (hereinafter simply referred to as a transistor), and an enhancement-mode FET is used as the current limiting device.

The major difference between the LED drive circuit 60 and the LED drive circuit 50 shown in FIG. 5 is that the voltage conversion circuits 51 and 53 in FIG. 5 are each replaced by a circuit comprising a resistor 61, 64 and a transistor 63, 66 in FIG. 6. As noted above, the voltage conversion circuits 51 and 53 in the LED drive circuit 50 of FIG. 5 have each been described as including a constant voltage generating circuit and an adder circuit. By contrast, in the LED drive circuit 60 of FIG. 6, the base-emitter voltage (0.6 V) of the transistor 63, 66 is utilized in place of the constant voltage generating circuit, the design being such that the emitter works to add the base-emitter voltage to the voltage obtained from the voltage dividing circuit 67 and its inverted output appears at the collector. This inverted output is used for negative feedback control of the FET 52, 54 (also for cutoff control in the case of the FET 52).

In the LED drive circuit 60, since the current flows to the emitter, the resistors 67*a* and 67*b* constituting the voltage dividing circuit 67 are each chosen to have a relatively small resistance value (for example, on the order of several kilo ohms) as compared to the resistors 17*a* and 17*b* used in the LED drive circuit 10 shown in FIG. 1. Since the resistance value of the current detecting resistor 68 is about tens of ohms, the effect that the voltage dividing circuit 67 will have on the current I is small. That is, in the LED drive circuit 60, as in the LED drive circuits 10, 30, 40, and 50 shown in FIGS. 1, 3, 4, and 5, respectively, since the FETs 52 and 54 constituting the bypass circuit and the current limiting circuit are respectively controlled by the voltage developed across the resistor 68 inserted for current detection and the voltage obtained by tapping the voltage at the intermediate point, the power loss due to the insertion of the current detecting resistor can be minimized.

Figure 7:
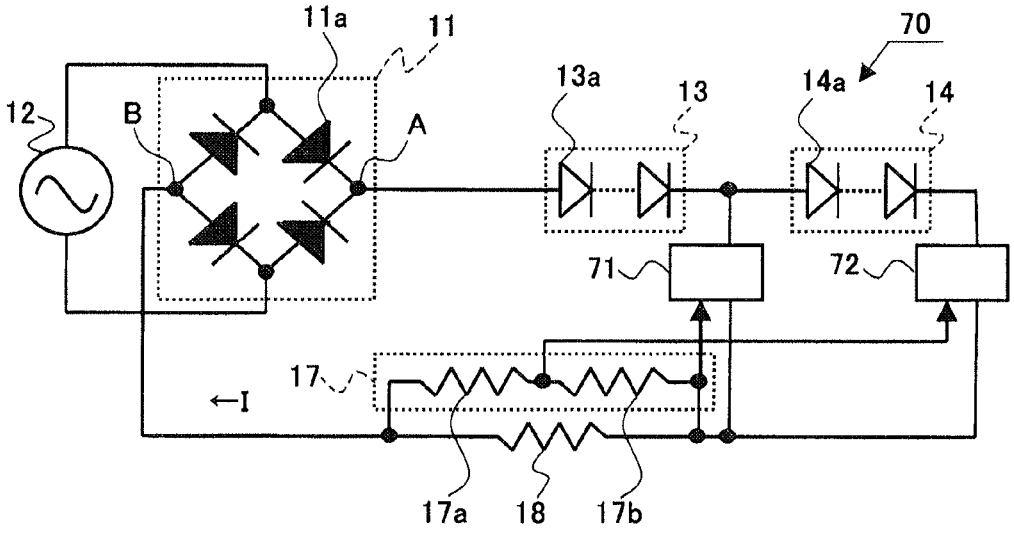
FIG. 7 is a circuit diagram of even another alternative LED drive circuit 70.

FIG. 7 is a circuit diagram of even another alternative LED drive circuit 70.

In the LED drive circuits 10, 30, 40, 50, and 60 shown in FIGS. 1, 3, 4, 5, and 6, respectively, the voltage at the low-voltage side terminal (in the figure, the left-hand terminal) of the voltage dividing circuit 17, 37, 47, 67 has been used as the control voltage. In the LED drive circuit 10, for example, in the high-voltage period of the full-wave rectified waveform (the period t3 in FIG. 2(*b*)), a large voltage drop occurs across the current detecting resistor (resistor 18) and the gate voltage significantly drops with respect to the source voltage of the FET 15; by taking advantage of this, control has been performed to cut off the FET 15. That is, the cutoff control of the FET 15 (in the period t2 shown in FIG. 2, the feedback control) has been performed by using the source voltage as the reference. However, the feedback control and cutoff control may be performed by using the voltage at the terminal B as the reference. That is, the bypass circuit closest to the bridge rectifier may be controlled using the terminal voltage at the high-voltage side of the voltage dividing circuit. The LED drive circuit 70 described hereinafter uses the terminal voltage at the high-voltage side of the voltage dividing circuit as the control voltage.

The LED drive circuit 70 differs from the LED drive circuit 10 shown in FIG. 1 in that the bypass circuit constructed from the FET 15 in FIG. 1 is replaced by a bypass circuit 71 in FIG. 7, in that the current limiting circuit 16 constructed from the FET 16 in FIG. 1 is replaced by a current limiting circuit 72 in FIG. 7, and in that the terminal voltage at the high-voltage side of the voltage dividing circuit 17 is used as the control voltage for the bypass circuit 71 in FIG. 7. Though not shown here, power supply voltage is input to the bypass circuit 71 and the current limiting circuit 72.

The bypass circuit 71 and the current limiting circuit 72 each include a voltage generating circuit and a voltage comparator. During the period (period t2 in FIG. 2(*b*)) when the voltage of the full-wave rectified waveform exceeds the threshold voltage of the LED sub-array 13 but is smaller than the sum of the threshold voltages of the LED sub-arrays 13 and 14, the current I flows through the LED sub-array 13 and thence through the bypass circuit 71. During this period, the voltage at the high-voltage side of the current detecting resistor 18 is fed back to the bypass circuit 71 which thus operates in a constant current mode. Since the divided voltage fed back to the current limiting circuit 72 is lower than the voltage fed back to the bypass circuit 71, the desired operation may not be achieved (due to an unstable operation because the feedback is insufficient), but this does not present any problem because no current flows to the LED sub-array 14.

In the LED drive circuit 10 shown in FIG. 1, feedback control has been performed by using the source voltage as the reference; by contrast, in the LED drive circuit 70, feedback control is performed by using the voltage at the terminal B as the reference. In the bypass circuit 71, the voltage generating circuit and the voltage comparator (operational amplifier) both operate with a DC power supply (not shown) referenced to the terminal B. The feedback control in the LED drive circuit 70 is performed to operate the bypass circuit 71 so as to reduce (increase) the current I, for example, by utilizing the phenomenon that the voltage at the right-hand terminal of the voltage dividing circuit 17 increases (decreases) relative to the voltage at the terminal B as the current I flowing through the LED sub-array 13 increases (decreases) during the period t2 shown in FIG. 2(*b*). That is, if the voltage fed back to the bypass circuit 71 is at the same level as the voltage at the current output side of the bypass circuit 71, this voltage can be used for feedback control because the voltage varies with the current I.

More specifically, a p-type enhancement-mode FET, for example, can be used as the current limiting device. The reason is that the p-type enhancement-mode FET has the property that the drain current decreases as the gate voltage increases. Alternatively, an n-type enhancement-mode FET may be used as the current limiting device, with provisions made to invert the varying voltage described above and to apply the inverted voltage to the gate of the n-type enhancement-mode FET. In either case, as in the LED drive circuit 50, the voltage must be converted (level shifted) to match the FET.

During the period (period t3 in FIG. 2(*b*)) when the voltage of the full-wave rectified waveform exceeds the sum of the threshold voltages of the LED sub-arrays 13 and 14, the current flows through the LED sub-arrays 13 and 14 and thence through the current limiting circuit 72. The current flowing through the LED sub-array 14 which cannot be controlled by the bypass circuit 71 causes the voltage at the right-hand terminal of the voltage dividing circuit 17 to rise. As a result, since the bypass circuit 71 cannot feedback control the current flowing through the LED sub-array, the condition for forming the negative feedback circuit no longer holds, and the feedback voltage becomes high enough to cut off the bypass circuit 71. When the bypass circuit 71 is cut off, all the current I flowing through the LED array passes through the current limiting circuit 72; as a result, similarly to the bypass circuit 71 in the period t2 of FIG. 2(*b*), the current limiting circuit 72 in the period t3 operates in a constant current mode based on the divided voltage fed back to it.

In the LED drive circuit 70, as in the LED drive circuits 10, 30, 40, 50, and 60 shown in FIGS. 1, 3, 4, 5, and 6, respectively, the bypass circuit 71 and the current limiting circuit 72 are respectively controlled by the voltage developed across the resistor 18 inserted for current detection and the voltage obtained by tapping the voltage at the intermediate point; as a result, the power loss due to the insertion of the current detecting resistor can be minimized, while increasing the amount of light emission.

Figure 8:
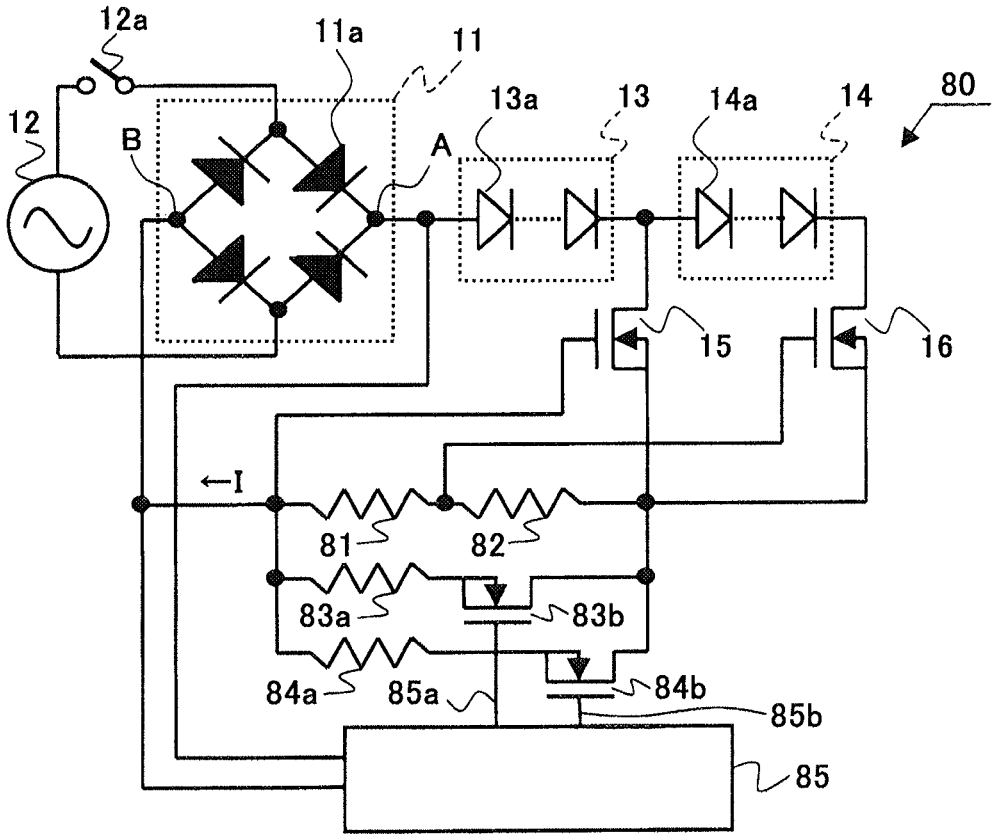
FIG. 8 is a circuit diagram of yet even another alternative LED drive circuit 80.

FIG. 8 is a circuit diagram of yet even another alternative LED drive circuit 80.

The LED drive circuit 80 shown in FIG. 8 comprises a bridge rectifier 11, LED sub-arrays 13 and 14, an FET 15 which is a bypass circuit as well as a current limiting device, an FET 16 which is a constant-current circuit as well as a current limiting device, resistors 81 and 82 constituting a voltage dividing circuit, a first current detecting resistor 83*a*, a second current detecting resistor 84*a*, enhancement-mode FETs 83*b* and 84*b* acting as switching devices, and a control circuit 85. The LED array in the LED drive circuit 80 is formed by connecting the LED sub-arrays 13 and 14 in series. For convenience of explanation, a commercial AC power supply 12 is also shown along with a wall switch 12*a*.

The bridge rectifier 11 is constructed from four diodes 11*a*, and its input terminals are connected to the commercial AC power supply 12 via the wall switch 12*a*. The bridge rectifier 11 outputs a full-wave rectified waveform from its terminal A, and the current returns to its terminal B. In the LED sub-array 13, a plurality of LEDs 13*a* are connected in series, and likewise, in the LED sub-array 14, a plurality of LEDs 14*a* are connected in series. The anode of the LED sub-array 13 is connected to the terminal A, and the cathode of the LED sub-array 13 is connected to the anode of the LED sub-array 14. The forward voltage of each of the LEDs 13*a* and 14*a* is about 3 V; therefore, when the rms value of the commercial AC power supply 12 is 230 V, the LED array is set up so that a total of about 80 LEDs 13*a* and 14*a* are connected in series in the LED array.

The bypass circuit is constructed from the FET 15 (current limiting device) which is a depletion-mode FET, and the constant-current circuit is constructed from the FET 16 (current limiting device) which is also a depletion-mode FET. The drain of the FET 15 is connected to a connection node (intermediate connection point) between the LED sub-array 13 and the LED sub-array 14, the source is connected to the right-hand terminal of the resistor 82 as well as to the drains of the FETs 83*b* and 84*b*, and the gate is connected to the left-hand terminals of the resistors 81, 83*a*, and 84*a* as well as to the terminal B. The drain of the FET 16 is connected to the cathode of the LED sub-array 14 (the end point of the LED array), the source is connected to the source of the FET 15, and the gate is connected to a connection node between the resistors 81 and 82. The right-hand terminal of the resistor 83*a* is connected to the source of the FET 83*b*, while the right-hand terminal of the resistor 84*a* is connected to the source of the FET 84*b*. The terminals A and B as a power supply are connected to the control circuit 85, and control signals 85*a* and 85*b* output from the control circuit 85 are applied to the gates of the FETs 83*b* and 84*b*, respectively.

The resistors 83*a* and 84*a* are the current detecting resistors, each on the order of tens of ohms. When the resistance values of the resistors 83*a* and 84*a* are denoted R83*a* and R84*a*, respectively, the relation R83*a*>R84*a* holds. The resistors 81 and 82 are connected in series, and this series resistance is connected in parallel with a series circuit of the resistor 83*a* and the FET 83*b* and a series circuit of the resistor 84*a* and the FET 84*b*. The resistors 81 and 82 each have a high resistance value (for example, on the order of tens to hundreds of kilo ohms), and together constitute the voltage dividing circuit for dividing the voltage developed across each of the current detecting resistors 83*a* and 84*a*.

The terminals A and B as a power supply are connected to the control circuit 85. The control circuit 85 comprises a sustain voltage supply circuit which generates low-voltage stable DC power from the full-wave rectified waveform, a toggle detector for detecting the ON/OFF operation of the wall switch 12*a*, logic circuits including a decoder and a counter for counting an output signal of the toggle detector, and a level shifter which converts the output signal of the decoder to a voltage that can sufficiently turn on and off the FETs 83*b* and 84*b*. Since the power consumption of the toggle detector, logic circuits, and level shifter can be made extremely low, the sustain voltage supply circuit can use a ceramic capacitor having a small capacitance. The control signals 85*a* and 85*b* are the output signals of the level shifter.

Each time the wall switch 12*a* is turned on, the state of the control signals 85*a* and 85*b* changes from "high and low" to "low and "high", and then to "high and high" in a cyclic fashion. When the control signals 85*a* and 85*b* are high and low, respectively, the FET 83*b* is turned on, and the FET 84*b* is turned off. When the control signals 85*a* and 85*b* are low and high, respectively, the FET 83*b* is turned off, and the FET 84*b* is turned on. When the control signals 85*a* and 85*b* are both high, the FETs 83*b* and 84*b* are both turned on.

Figure 9:
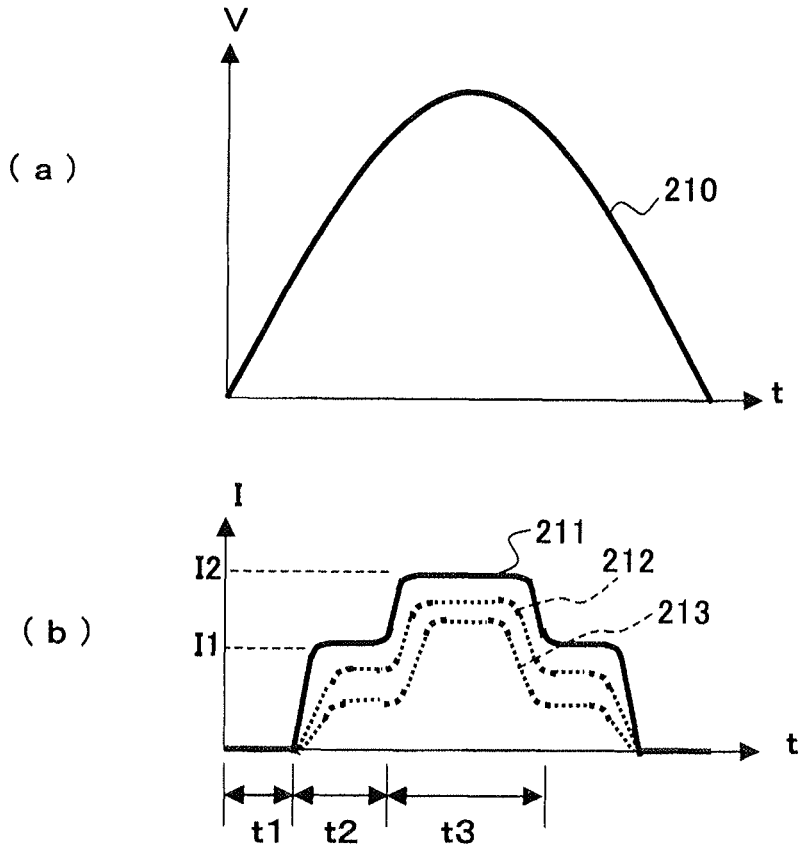
FIG. 9(*a*) is a diagram showing one period of a full-wave rectified waveform, and FIG. 9(*b*) is a diagram showing current I flowing in the LED drive circuit 80.

FIG. 9(*a*) is a diagram showing one period of the full-wave rectified waveform, and FIG. 9(*b*) is a diagram showing the current I flowing in the LED drive circuit 80.

In FIG. 9(*a*), the ordinate V represents the voltage at the terminal A relative to the terminal B. In FIGS. 9(*a*) and 9(*b*), the time t is plotted along the abscissa, and the same time axis is used for both figures. In FIG. 9(*b*), a current waveform 211 shown by a solid line corresponds to the brightest state, a current waveform 212 shown by a dotted line corresponds to the next brightest state, and a current waveform 213 shown by a dotted line corresponds to the darkest state. In FIG. 9(*b*), the current flowing to the control circuit 85 is ignored.

In the case of the current waveform 211 shown in FIG. 9(*b*), the control signals 85*a* and 85*b* are both high, so that the FETs 83*b* and 84*b* are both ON. The current detecting resistance for detecting the current flowing through the LED array is formed by connecting the resistors 83*a* and 85*b* in parallel, and in this case, the largest current I flows in the LED drive circuit 80.

As shown in FIG. 9(*b*), the current I is zero during the period t1 when the voltage of the full-wave rectified waveform 210 shown in FIG. 9(*a*) is below the threshold voltage of the LED sub-array 13. During the period t2 when the voltage of the full-wave rectified waveform 210 exceeds the threshold voltage of the LED sub-array 13 but is smaller than the sum of the threshold voltages of the LED sub-arrays 13 and 14, the current I flows through the LED sub-array 13 and thence through the FET 15. During this period, the voltage drop due to the current detecting resistance (the combined resistance of the parallel circuit formed by the resistors 83*a* and 84*a*) is fed back to the FET 15 which thus operates in a constant current mode. When the voltage of the full-wave rectified waveform 210 further rises, and exceeds the sum of the threshold voltages of the LED sub-arrays 13 and 14, that is, during the period t3, the current also flows through the LED sub-array 14. At this time, the voltage drop due to the current detecting resistance increases, so that the FET 15 is cut off. On the other hand, the voltage divided between the resistors 81 and 82 is fed back to the FET 16 which thus operates in a constant current mode. The process that takes place during the period that the voltage of the full-wave rectified waveform 210 falls is the reverse of the process that takes place during the period that the voltage of the full-wave rectified waveform 210 rises.

In the case of the current waveform 212 shown in FIG. 9(*b*), the control signals 85*a* and 85*b* are low and high, respectively, so that the FET 83*b* is OFF and the FET 84*b* is ON. The current detecting resistance for detecting the current flowing through the LED array is formed only by the resistor 84*a*, and in this case, the next largest current I flows in the LED drive circuit 80.

In this case, since the resistance value of the current detecting resistor 84*a* is larger than the combined resistance of the parallel circuit formed by the resistors 83*a* and 84*a*, a larger feedback can be applied to the FETs 15 and 16 even though the current I is smaller. As a result, the current I flowing in the LED drive circuit 80 is smaller, as indicated by the current waveform 212, than the above case (the current waveform 211). The periods t1, t2, and t3 determined by the threshold voltage are common to both cases (the same applies hereinafter).

In the case of the current waveform 213 shown in FIG. 9(*b*), the control signals 85*a* and 85*b* are high and low, respectively, so that the FET 83*b* is ON and the FET 84*b* is OFF. The current detecting resistance for detecting the current flowing through the LED array is formed only by the resistor 83*a*. Since R83*a*>R84*a*, as earlier described, the current flowing in the LED drive circuit 80 is the smallest in this case.

Figure 26:
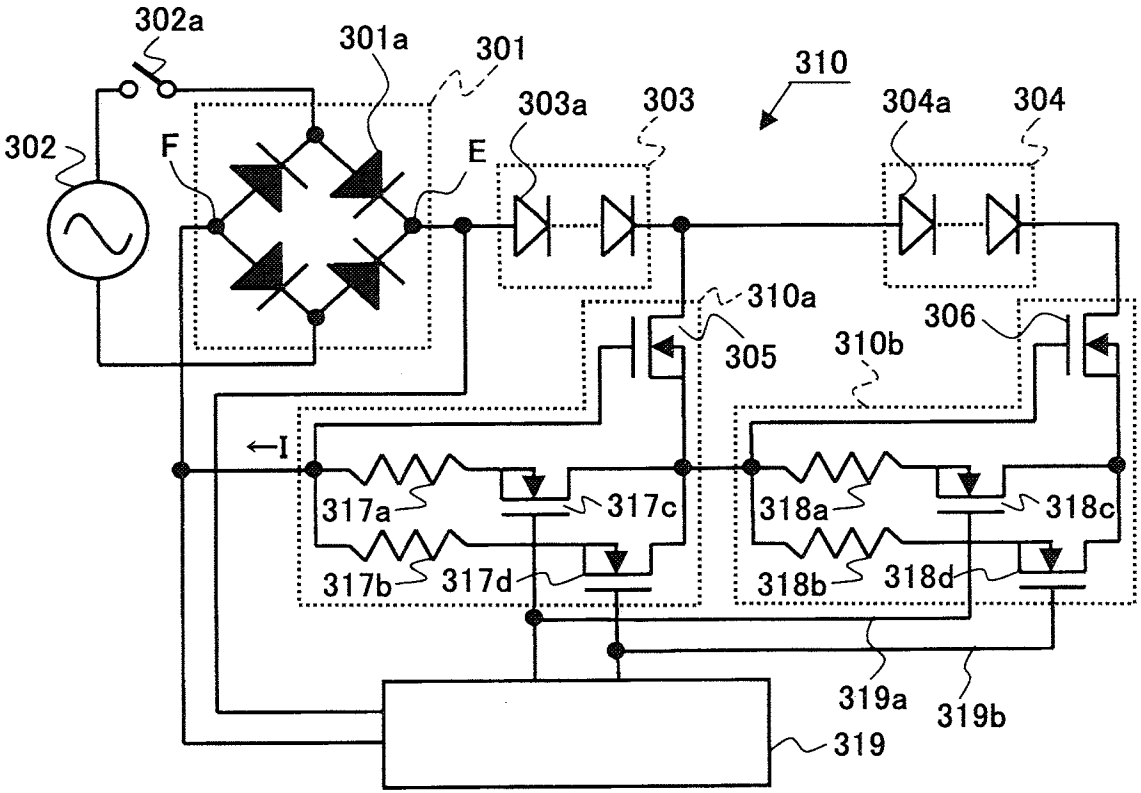
FIG. 26 is a circuit diagram of a circuit constructed by modifying the LED drive circuit 300 of FIG. 25 so as to be able to control the light output.
Figure 27:
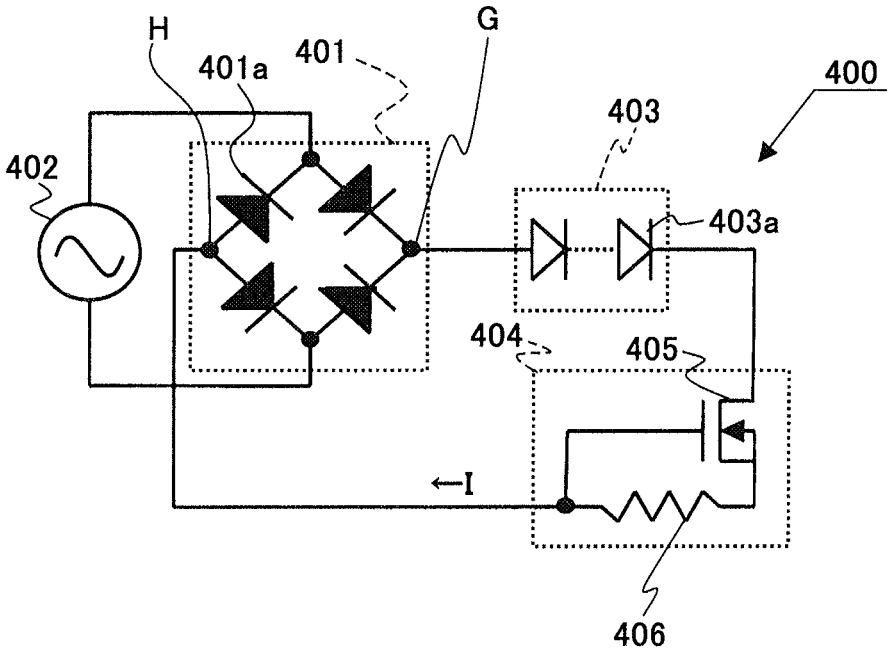
FIG. 27 is a circuit diagram of a prior art LED drive circuit 400.

As described above, the LED drive circuit 80 detects the ON/OFF operation of the wall switch 12*a*, and controls the light output by selecting the current I such as indicated by the current waveform 211, 212, or 213. At this time, the feedback voltage to the FET 16 is obtained from the voltage dividing circuit formed by the resistors 81 and 82. Accordingly, the number of switching devices (FETs 15 and 16) used in the LED drive circuit 80 is one half of the number of switching devices (FETs 317*c*, 317*d*, 318*c*, and 318*d*) used in the LED drive circuit 310 shown in FIG. 26.

Further, since the FETs 15 and 16 are located closer to the terminal B, the FETs 15 and 16 can be controlled with low voltages, which serves to simplify (or eliminate the need for) the level shifter incorporated in the control circuit 85. Furthermore, the absence of an interposing resistor between the source of the FET 15 and the source of the FET 16 serves to eliminate the power loss that would occur due to the insertion of such a resistor, and since the transition period from the first constant current operation mode to the second constant current operation mode becomes short, the amount of light emission of the LED drive circuit 80 is larger than the amount of light emission of the LED drive circuit 310.

In the LED drive circuit 80, the light output is controlled in three steps, but the number of steps of the light output control may be increased by increasing the number of circuits each comprising a switching FET and a resistor connected in series with the FET and by expanding the functions of the logic circuits contained in the control circuit 85.

Figure 10:
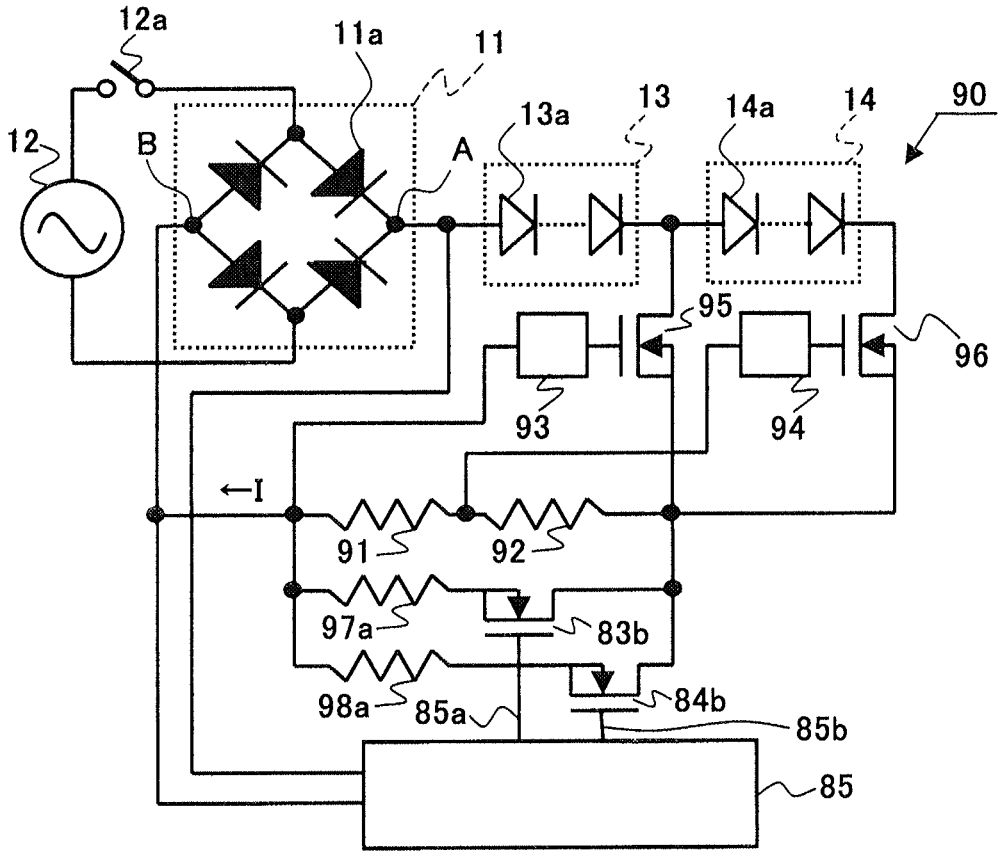
FIG. 10 is a circuit diagram of a further alternative LED drive circuit 90.

FIG. 10 is a circuit diagram of a further alternative LED drive circuit 90.

The LED drive circuit 80 shown in FIG. 8 has been described as using the depletion-mode FETs 15 and 16 as the current limiting devices constituting the bypass circuit and the constant-current circuit. However, such current limiting devices need not be limited to depletion-mode FETs, but use may be made of enhancement-mode FETs or bipolar transistors. The LED drive circuit 90 hereinafter described uses enhancement-mode FETs as the current limiting devices.

The LED drive circuit 90 differs from the LED drive circuit 80 shown in FIG. 8 in that, in FIG. 10, the bypass circuit is constructed from a combination of a voltage conversion circuit 93 and an enhancement-mode FET 95, in that the constant-current circuit is constructed from a combination of a voltage conversion circuit 94 and an enhancement-mode FET 96, and in that the resistance values of the corresponding resistors 91, 92, 97*a*, and 98*a* are different.

A voltage from the left-hand terminal of the resistor 91 is input to the voltage conversion circuit 93, and a voltage divided between the resistors 91 and 922 is input to the voltage conversion circuit 94. Power supply, etc., not shown are also input to the voltage conversion circuits 93 and 94. The voltage conversion circuits 93 and 94 each include a constant voltage generating circuit and an adder circuit and, if necessary, further include a smoothing circuit, a voltage drop circuit, etc., in order to obtain a stable DC power supply.

As opposed to the depletion-mode FETs 15 and 16 (see FIG. 8) where the gate-to-source voltage that causes current to flow (the FET threshold voltage) has a negative value, the enhancement-mode FETs 95 and 96 have a positive threshold voltage. In each of the voltage conversion circuits 93 and 94, the voltage generated by the constant voltage generating circuit and the voltage obtained from the voltage dividing circuit are added together (or one is subtracted from the other), and the resulting voltage is used to control the current flowing to the FET 95 or 96. That is, negative feedback control of the FETs 95 and 96 and cutoff control of the FET 95 are performed in a manner similar to the bypass circuit (FET 15) and current limiting circuit (FET 16) shown in FIG. 8.

In the LED drive circuit 90, as in the LED drive circuit 80 shown in FIG. 8, the resistance values R97*a* and R98*a* of the resistors 97*a* and 98*a* are on the order of tens of ohms, and the relation R97*a*>R98*a* holds. The resistors 91 and 92 each have a high resistance value.

Figure 11:
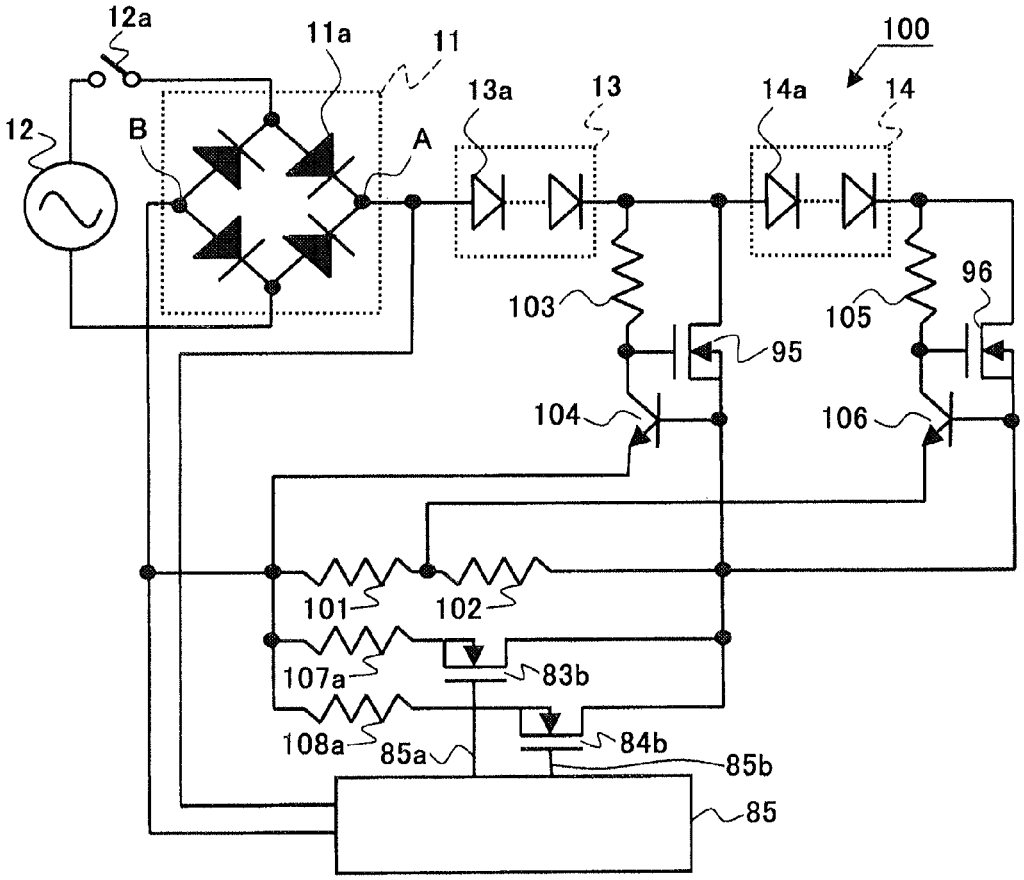
FIG. 11 is a circuit diagram of a still further alternative LED drive circuit 100.

FIG. 11 is a circuit diagram of a still further alternative LED drive circuit 100.

In the LED drive circuit 90 shown in FIG. 10, the voltage conversion circuits 93 and 94 have each been described as including a constant voltage generating circuit and an adder circuit. However, the construction of the voltage conversion circuit can be simplified using a bipolar transistor. In the LED drive circuit 100 described hereinafter, the bypass circuit and the current limiting circuit each include a bipolar transistor (hereinafter simply referred to as a transistor), and an enhancement-mode FET is used as the current limiting device.

The major difference between the LED drive circuit 100 and the LED drive circuit 90 shown in FIG. 10 is that the voltage conversion circuits 93 and 94 in FIG. 10 are each replaced by a circuit comprising a resistor 103, 105 and a transistor 104, 106 in FIG. 11. The voltage conversion circuits 93 and 94 in the LED drive circuit 90 of FIG. 10 have each been described as including a constant voltage generating circuit and an adder circuit. By contrast, in the LED drive circuit 100 of FIG. 11, the base-emitter voltage (0.6 V) of the transistor 104, 106 is utilized in place of the constant voltage generating circuit. That is, the design is such that the emitter of the transistor 104, 106 works to add the base-emitter voltage to the voltage obtained from the voltage dividing circuit (the series circuit of the resistors 101 and 102) and its inverted output appears at the collector. The inverted output of the transistor 104, 106 is used for negative feedback control of the FET 95, 96 (also for cutoff control in the case of the FET 95).

In the LED drive circuit 100, since the current flows to the emitter, the resistors 101 and 102 are each chosen to have a relatively small resistance value (for example, on the order of several kilo ohms) as compared to the resistors 91 and 92 in the LED drive circuit 80 shown in FIG. 8. Since the resistance value of the current detecting resistor 107*a*, 108*a* is about tens of ohms, the effect that the voltage dividing circuit (the series circuit of the resistors 101 and 102) will have on the current I is small.

Figure 12:
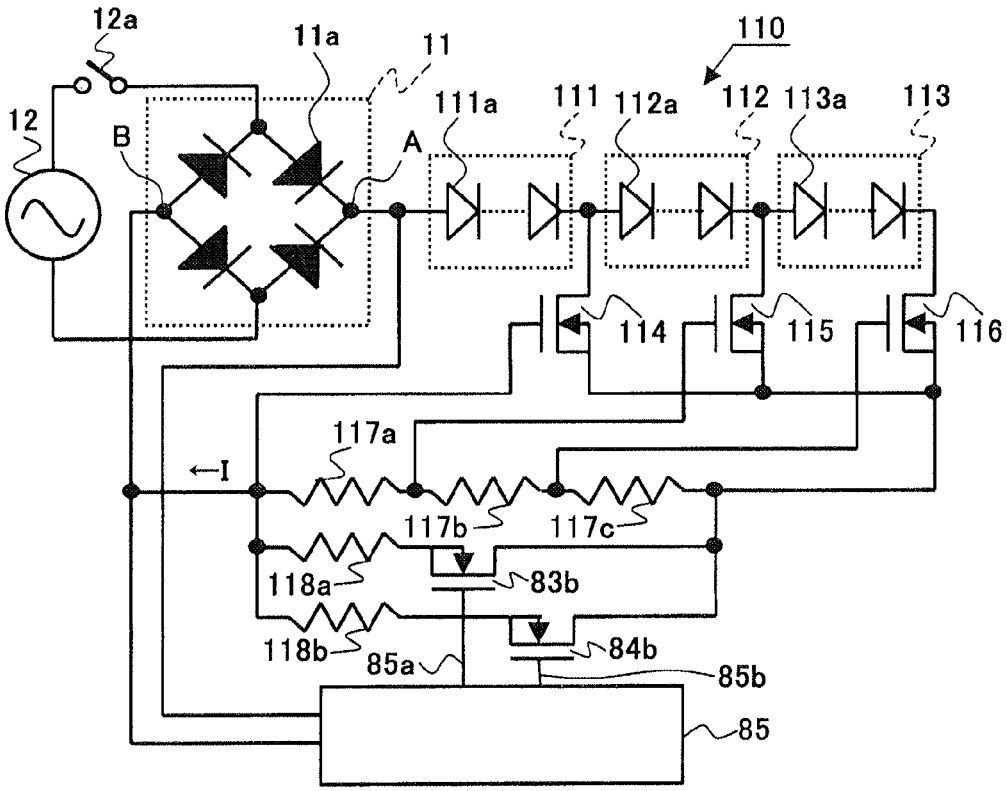
FIG. 12 is a circuit diagram of a yet further alternative LED drive circuit 110.

FIG. 12 is a circuit diagram of a yet further alternative LED drive circuit 110.

In the LED drive circuits 80, 90, and 100 shown in FIGS. 8, 10 and 11, the LED array has been described as comprising two LED sub-arrays 13 and 14. However, the number of LED sub-arrays constituting the LED array need not be limited to two. In the LED drive circuit 110 described hereinafter, the LED array comprises three LED sub-arrays 111, 112, and 113.

In FIG. 12, the LED drive circuit 110 comprises a bridge rectifier 11, the LED sub-arrays 111, 112, and 113, FETs 114 and 115 each of which is a bypass circuit as well as a current limiting device, an FET 116 which is a constant-current circuit as well as a current limiting device, a voltage dividing circuit constructed by connecting resistors 117*a*, 117*b*, and 117*c* in series, current detecting resistors 118*a* and 118*b* which are selectively controlled, FETs 83*b* and 84*b* as switching devices for selective control, and a control circuit 85. The LED array in the LED drive circuit 110 is formed by connecting the LED sub-arrays 111, 112, and 113 in series. For convenience of explanation, a commercial AC power supply 12 is also shown along with a wall switch 12*a*.

In FIG. 12, the commercial AC power supply 12, the wall switch 12*a*, the bridge rectifier 11, the FETs 83*b* and 84*b*, and the control circuit 85 are identical to those of the LED drive circuit 80. The LED sub-arrays 111, 112, and 113 are each constructed by connecting a plurality of LEDs 111*a*, 112*a*, or 113*a* in series. The LED sub-arrays 111 to 113 are also connected in series. The anode of the LED sub-array 111 is connected to the terminal A of the bridge rectifier 11. The connection nodes (intermediate connection points) between the respective LED sub-arrays 111, 112, and 113 and the cathode of the LED sub-array 113 (the end point of the LED array) are respectively connected to the drains of the FETs 114, 115, and 116. Since the forward voltage of each of the LEDs 111*a*, 112*a*, and 113*a* is about 3 V, it follows that when the rms value of the commercial AC power supply 12 is 230 V, a total of about 80 LEDs 111*a*, 112*a*, and 113*a* are connected in series in the LED array.

The two bypass circuits comprise the depletion-mode FETs 114 and 115 (current limiting devices), respectively. Likewise, the constant-current circuit comprises the depletion-mode FET 116 (current limiting device). The sources of the FETs 114, 115, and 116 are interconnected and are connected to the drains of the FETs 83*b* and 84*b* as well as to the right-hand terminal of the resistor 117*c*. The gate of the FET 114 is connected to the left-hand terminals of the resistors 117*a*, 118*a*, and 118*b* as well as to the terminal B of the bridge rectifier 11. The gate of the FET 115 is connected to the connection node between the resistors 117*a* and 117*b*. The gate of the FET 116 is connected to the connection node between the resistors 117*b* and 117*c*.

The resistors 118*a* and 118*b* are the current detecting resistors, each on the order of tens of ohms. When the resistance values of the resistors 118*a* and 118*b* are denoted R118*a* and R118*b*, respectively, the relation R118*a*>R118*b* holds. The resistors 117*a* to 117*c* each have a high resistance value (for example, on the order of tens to hundreds of kilo ohms). When the number of LED sub-arrays in the LED array is increased, the non-emission period t1 shown in FIG. 9(*b*) can be shortened, and the number of steps in which the current varies increases, so that the current waveform becomes closer to a sinusoidal wave; as a result, the power factor and distortion factor both improve and the flicker decreases.

Figure 13:
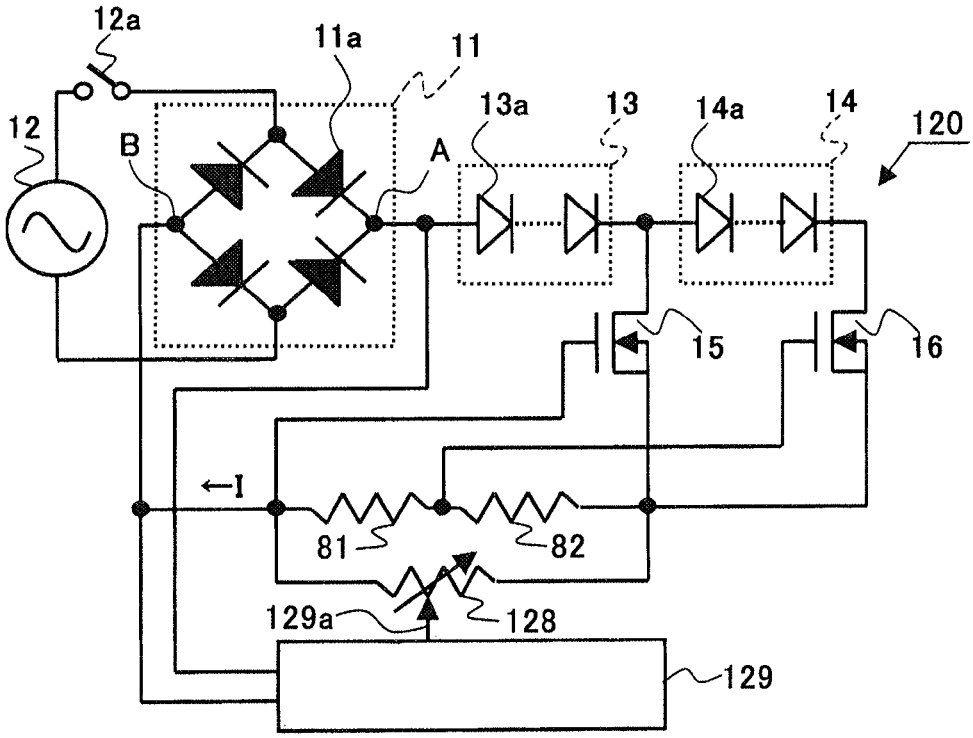
FIG. 13 is a circuit diagram of a still yet further alternative LED drive circuit 120.

FIG. 13 is a circuit diagram of a still yet further alternative LED drive circuit 120.

In the LED drive circuits 80, 90, 100, and 110 shown in FIGS. 8, 10, 11, and 12, the light output has been controlled in three steps by switching between the current detecting resistors 83*a*, 84*a*, etc., However, the current detecting resistance may be varied continuously. In the LED drive circuit 120 described hereinafter, a device (hereinafter called a volume) whose resistance value can be varied with the applied voltage is used as the current detecting resistor.

The LED drive circuit 120 differs from the LED drive circuit 80 shown in FIG. 8 in that the circuits comprising the FETs 83*b* and 84*b* and the current detecting resistors 83*a* and 84*a*, respectively, in FIG. 8 are together replaced by a volume 128 and, consequently, the control circuit 85 is replaced by a control circuit 129. A D/A converter is incorporated in the control circuit 129, and a control voltage 129*a* is increased or decreased each time the ON/OFF operation of the wall switch 12*a* is performed. The control voltage 129*a* is applied to a control terminal of the volume 128. The LED drive circuit 120 controls the light output by varying the resistance value of the volume 128 in accordance with the control voltage 129*a*. In the LED drive circuit 120, since the switching devices can be eliminated, not only does the circuit size become smaller, but the number of steps of the light output control can be easily increased.

Figure 14:
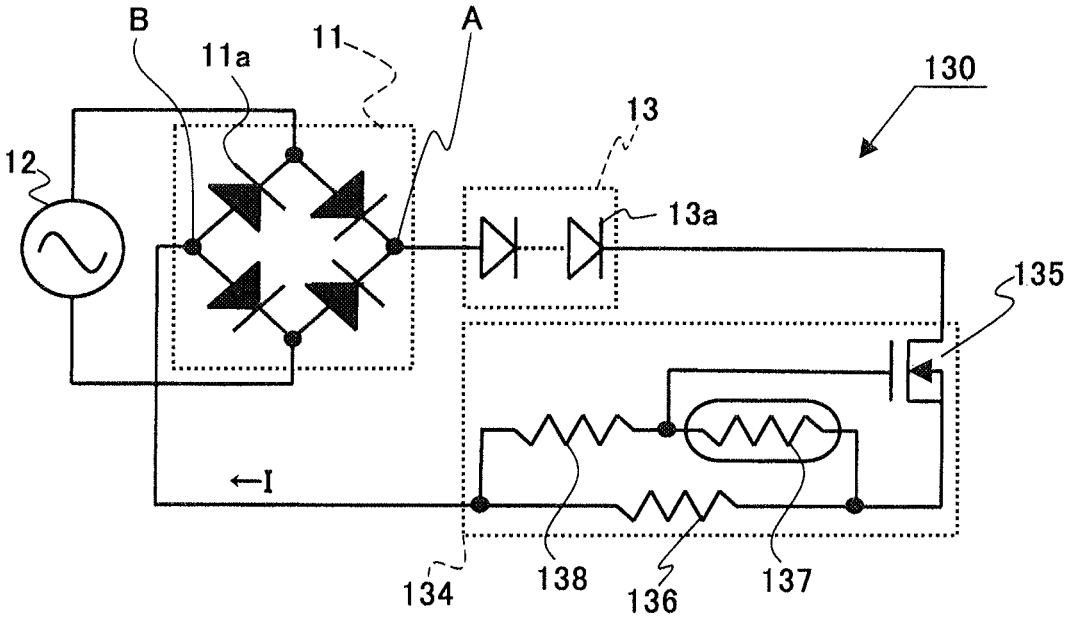
FIG. 14 is a circuit diagram of an even further alternative LED drive circuit 130.

FIG. 14 is a circuit diagram of an even further alternative LED drive circuit 130.

As shown in FIG. 14, the LED drive circuit 130 comprises a bridge rectifier 11, an LED array 13, and a constant-current circuit 134. For convenience of explanation, a commercial AC power supply 12 is also shown.

In FIG. 14, the commercial power supply 12 is connected to input terminals of the bridge rectifier 11. The bridge rectifier 11 is constructed from four diodes 11*a*, and has a terminal A for outputting a full-wave rectified waveform and a terminal B to which current I is returned. The LED array 13 is constructed by connecting a plurality of LEDs 13*a* in series, and its anode is connected to the terminal A of the bridge rectifier 11, while its cathode is connected to the drain of a depletion-mode FET 135 (current limiting device, hereinafter referred to as the FET) contained in the constant-current circuit 134. The constant-current circuit 134 includes, in addition to the FET 135, a current detecting resistor 136 and a series circuit (voltage dividing circuit) of a thermistor 137 and a resistor 138. The series circuit is connected in parallel with the current detecting resistor 136. One end of the current detecting resistor 136 is connected to the source of the FET 135, and the other end is connected to the terminal B of the bridge rectifier 11. The connection node between the thermistor 137 and the resistor 138 is connected to the gate of the FET 135.

Since the forward voltage of each LED 13*a* is about 3 V, it follows that when the rms value of the commercial AC power supply 12 is 230 V, a total of about 80 LEDs 13*a* are connected in series in the LED array 13. The resistance value of the current detecting resistor 136 is on the order of tens of ohms, and the thermistor 137 and the resistor 138 each need only be chosen to have a resistance value in the range of several to several hundred kilo ohms. That is, since the gate of the FET 135 is controlled only by a voltage, and no current flows to it, most of the current I flowing through the LED array 13 and the FET 135 flows through the current detecting resistor 136. Accordingly, since the thermistor 137 and the resistor 138 can each be chosen to have a high resistance value, the allowable loss and the allowable current can be reduced.

Figure 15:
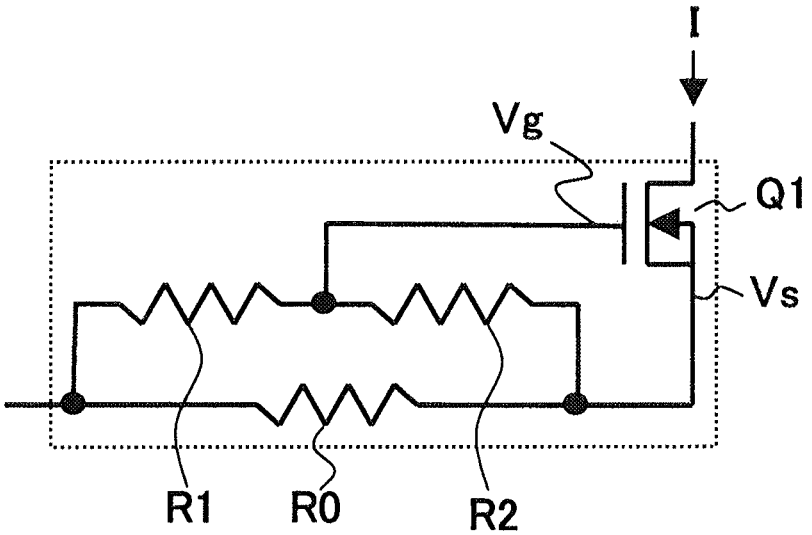
FIG. 15 is a circuit diagram for explaining a constant-current circuit 134 shown in FIG. 14.

FIG. 15 is a circuit diagram for explaining the constant-current circuit 134 shown in FIG. 14.

In FIG. 15, R0 corresponds to the current detecting resistor 136, R1 corresponds td the resistor 138, R2 corresponds the thermistor 137, and FET Q1 corresponds to the FET 135. In FIG. 15, the resistors and their resistance values are designated by the same reference numerals R0, R1, and R2.

The current I flowing to the FET Q1 is a function f of the difference between the gate voltage Vg and the source voltage Vs, and can be expressed as shown in the following equation (1).

$$I=f(Vg-Vs) \tag{1}$$

Since the resistors R1 and R2 are high-value resistors, the current flowing through the resistors R1 and R2 is ignored, and the reference voltage is taken at the left-hand terminal of the current detecting resistor R0; then, the voltage across the current detecting resistor R0 is given as R0·I. Hence, the gate voltage Vg can be expressed as shown in the following equation (2).

$$Vg=R1\cdot R0\cdot I/(R1+R2) \tag{2}$$

Since the source voltage Vs is the voltage at the right-hand terminal of the current detecting resistor R0, the source voltage Vs can be expressed as shown in the following equation (3).

$$Vs=R0\cdot I \tag{3}$$

From the equations (2) and (3), Vg−Vs can be expressed as shown in the following equation (4), and the equation (1) can be transformed as shown in the following equation (5). That is, the current I expressed by the equation (5) flows in the constant-current circuit 134.

$$Vg-Vs=-R2\cdot R0\cdot 1/(R1+R2) \tag{4}$$

$$I=f\{-R2\cdot R0\cdot 1/(R1+R2)\} \tag{5}$$

In the circuit (constant-current circuit 134) shown in FIG. 15, when the current I increases, causing the source voltage Vs to increase by ΔV, the gate voltage Vg increases by R1/(R1+R2)ΔV, and the gate-source voltage (Vg−Vs) decreases, thus trying to reduce the current flowing to the FET Q1. Conversely, when the current I decreases, the circuit works to increase the current I flowing to the FET Q1. In this way, in the constant-current circuit 134, negative feedback is applied by the divided voltage (gate voltage Vg), and the current I is maintained constant.

Next, temperature compensation will be described with reference to FIG. 14.

The thermistor 137 is a positive-type thermistor whose resistance value increases with increasing temperature. Accordingly, as the temperature increases, the divided voltage decreases, so that the current I flowing to the FET Q1 decreases. The positive-type thermistor 137 is advantageous in preventing breakdown due to heating, because its rate of change of resistance is larger than that of a negative-type thermistor. If a rate of change of resistance as large as that of a positive-type thermistor is not needed, a negative-type thermistor may be used. In that case, the thermistor 137 in FIG. 14 is replaced by a fixed resistor, and the resistor 138 is replaced by a negative-type thermistor.

Figure 16:
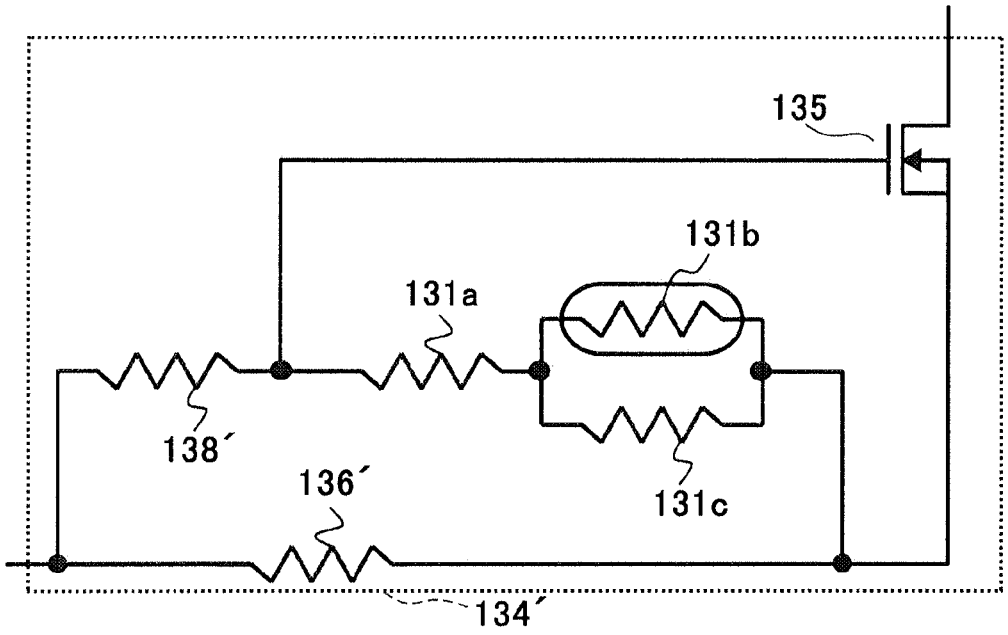
FIG. 16 is a circuit diagram showing an alternative constant-current circuit 134'.

FIG. 16 is a circuit diagram showing an alternative constant-current circuit 134'.

In the LED drive circuit 130 shown in FIG. 14, the voltage dividing circuit contained in the constant-current circuit 134 is constructed from a series circuit of the thermistor 137 and the resistor 138. However, there may be cases where the desired temperature characteristics cannot be obtained with the series circuit of the thermistor 137 and the resistor 138. In view of this, a constant-current circuit capable of varying the temperature characteristics will be described below. The constant-current circuit 134' shown in FIG. 16 can be used in place of the constant-current circuit 134 in the LED drive circuit 130 shown in FIG. 14.

In FIG. 16, the right side of the figure corresponds to the high-voltage side, and the left side corresponds to the low-voltage side. As shown in FIG. 16, the constant-current circuit 134' comprises a thermistor 131*b*, a resistor 131*c* connected in parallel with the thermistor 131*b*, a resistor 131*a* connected in series with this parallel circuit, and a resistor 138' connected in series with the resistor 131*a*. When a comparison is made between the constant-current circuit 134 shown in FIG. 14 and the constant-current circuit 134' shown in FIG. 16, the thermistor 137 in FIG. 14 corresponds to the circuit comprising the resistor 131*a*, thermistor 131*b*, and resistor 131*c* in FIG. 16, the resistor 138 in FIG. 14 corresponds to the resistor 138' in FIG. 16, and the resistor 136 in FIG. 14 corresponds to the resistor 136' in FIG. 16. By adjusting the values of the resistors 131*a* and 131*c*, the desired temperature characteristics can be obtained.

Figure 17:
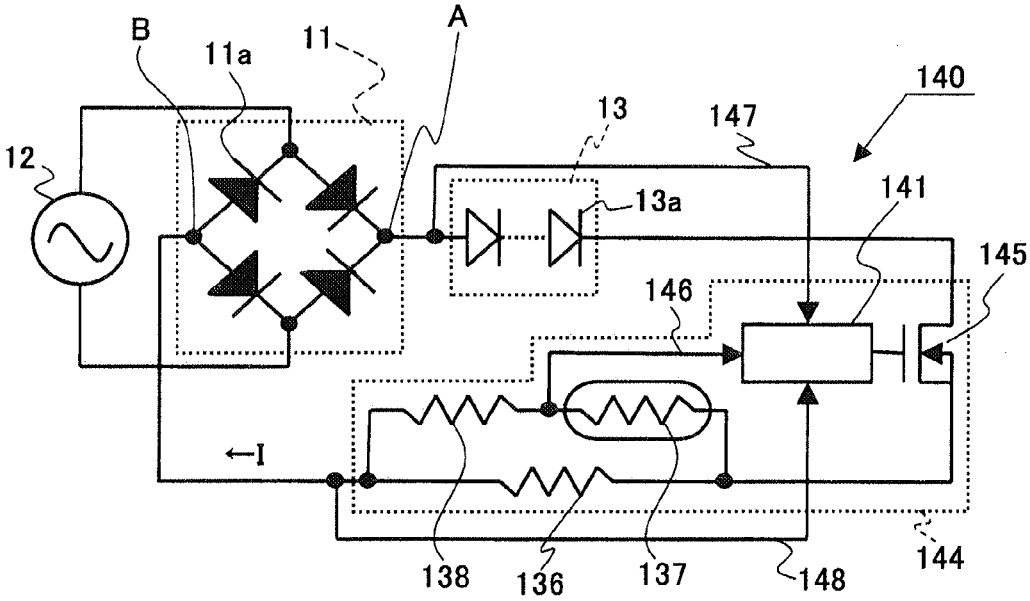
FIG. 17 is a circuit diagram of a still even further alternative LED drive circuit 140.

FIG. 17 is a circuit diagram of a still even further alternative LED drive circuit 140.

In the LED drive circuit 130 shown in FIG. 14, the constant-current circuit 134 is constructed by using the depletion-mode FET 135 as the current limiting device. However, enhancement-mode FETs or junction FETs are often more readily available than depletion-mode FETs. It is also possible to use a three-terminal regulator as the current limiting device, as previously described. The LED drive circuit hereinafter describes uses an enhancement-mode FET as the current limiting device in the constant-current circuit.

FIG. 17 differs from the circuit diagram of FIG. 14 in that the FET 145 is an enhancement-mode FET, and in that the constant-current circuit 144 includes a voltage conversion circuit 141 which is placed directly before the gate of the FET 145. A divided voltage 146 obtained from the voltage dividing circuit comprising the thermistor 137 and resistor 138, a positive power supply 147, and a negative power supply 148 are coupled to the voltage conversion circuit 141 contained in the constant-current circuit 144. The voltage conversion circuit 141 includes a constant voltage generating circuit and an adder circuit and, if necessary, further include a smoothing circuit, a voltage drop circuit, etc., in order to obtain a stable DC power supply.

In the enhancement-mode FET, the gate-to-source voltage that causes current to flow (the threshold voltage) has a positive value, unlike the depletion-mode FET which has a negative threshold voltage. In the voltage conversion circuit 141, the voltage generated by the constant voltage generating circuit is added to the divided voltage 146 (or one is subtracted from the other), and the resulting voltage is used to control the current flowing to the FET 145. That is, negative feedback is applied to the FET 145 to maintain the current I constant, as in the constant-current circuit 134 of FIG. 14. Further, using the thermistor 137, temperature compensation is applied to the current I.

In the constant-current circuits 134 and 144 contained in the respective LED drive circuits 130 and 140 and the constant-current circuit 134' shown in FIG. 16, the load circuit is the LED array 13. However, the load circuit need not necessarily be limited to an LED array, but the constant-current circuits 134, 134', and 144 are also effective for other load circuits that need temperature compensation for the current value.

Figure 18:
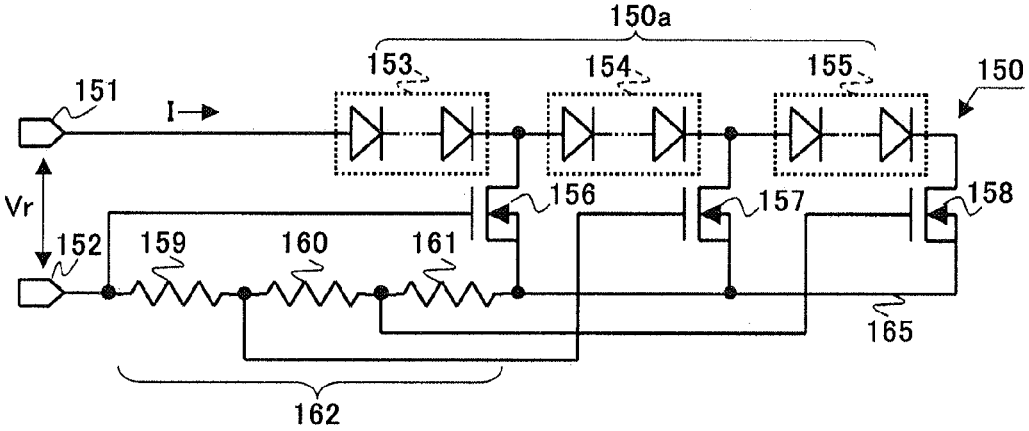
FIG. 18 is a circuit diagram showing an LED module 150.

FIG. 18 is a circuit diagram showing an LED module 150.

The LED module 150 comprises terminals 151 and 152, LED sub-arrays 153, 154, and 155 each constructed by connecting a plurality of LEDs in series, depletion-mode FETs 156, 157, and 158 (hereinafter called the FETs), and a current detecting resistor 162. The current detecting resistor 162 is formed by connecting resistors 159, 160, and 161 in series.

Figure 20:
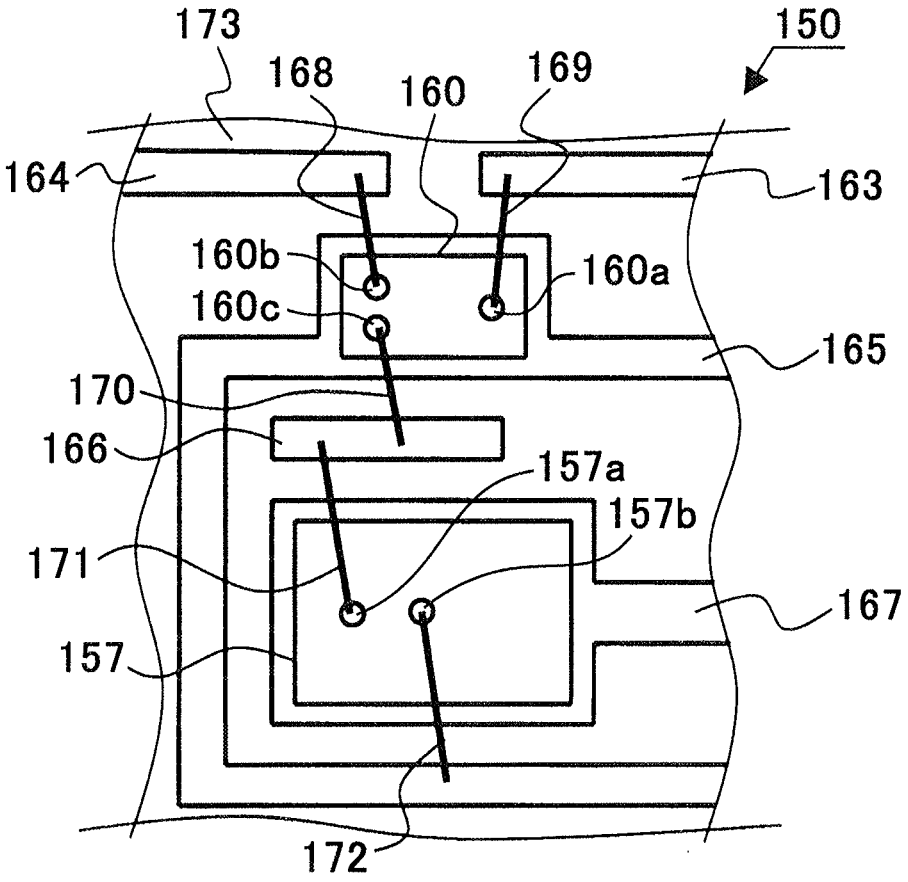
FIG. 20 is a diagram for explaining how devices and wiring lines are arranged on the LED module 150.

The LED module 150 includes an LED array 150*a* which is formed by connecting a plurality of LEDs in series on a module substrate 173 (see FIG. 20). The LED array 150*a* is constructed from a series connection of the LED sub-arrays 153, 154, and 155. A bypass circuit formed by the FET 156 is connected to a connection node between the LED sub-arrays 153 and 154 which is an intermediate connection point taken along the LED array 150*a*. A bypass circuit formed by the FET 157 is connected to a connection node between the LED sub-arrays 154 and 155 which is another intermediate connection point taken along the LED array 150*a*. A current limiting circuit formed by the FET 158 is connected to the right edge of the LED sub-array 155, i.e., the end point of the LED array 150*a*. The voltage developed across the current detecting resistor 162 formed by connecting the resistors 159, 160, and 161 in series is divided through the respective resistors 159, 160, and 161.

A full-wave rectified waveform Vr is applied between the terminals 151 and 152. During the period when the voltage of the full-wave rectified waveform Vr is lower than the threshold voltage of the LED sub-array 153, no circuit current I flows. During the period when the voltage of the full-wave rectified waveform Vr is higher than the threshold voltage of the LED sub-array 153 but lower than the sum of the threshold voltages of the LED sub-arrays 153 and 154, the circuit current I flows through the LED sub-array 153 and thence through the FET 156. During this period, the FET 156 operates in a constant current mode by feedback through the resistor 162.

During the period when the voltage of the full-wave rectified waveform Vr is higher than the sum of the threshold voltages of the LED sub-arrays 153 and 154 but lower than the sum of the threshold voltages of the LED sub-arrays 153, 154, and 155, the circuit current I flows through the LED sub-arrays 153 and 154 and thence through the FET 157. During this period, since the gate voltage of the FET 156 becomes lower than the gate voltage of the FET 157, the FET 156 is cut off. Further, during this period, the FET 157 operates in a constant current mode by feedback through the resistors 160 and 161.

During the period when the voltage of the full-wave rectified waveform Vr is higher than the sum of the threshold voltages of the LED sub-arrays 153, 154, and 155, the circuit current I flows through the LED sub-arrays 153, 154, and 155 and thence through the FET 158. During this period, since the gate voltages of the FETs 156 and 157 each become lower than the gate voltage of the FET 158, the FETs 156 and 157 are cut off. Further, during this period, the FET 158 operates in a constant current mode by feedback through the resistor 161.

As described above, the period during which all of the LED sub-arrays 153, 154, and 155 are OFF, the period during which only the LED sub-array 153 is ON, the period during which the LED sub-arrays 153 and 154 are ON, and the period during which all of the LED sub-arrays 153, 154, and 155 are ON appear in sequence as the voltage of the full-wave rectified waveform Vr varies. The resistors 159, 160, and 161 are preferably set to have the same value. If the resistors 159, 160, and 161 are set to have the same value, the burden of preparing and managing the resistors eases. Further, compared with the case where the resistors 159, 160, and 161 are connected separately to the sources of the respective FETs 156, 157, and 158 (for example, as in FIG. 25), connecting the resistors 159, 160, and 161 in a clustered manner offers the following advantage. That is, in the LED module 150, since the sources of the FETs 156, 157, and 158 are connected together by a common interconnect line 165, the transient period (for example, the transition period during which a transition is made from the constant current operating state of the FET 157 to the constant current operating state of the FET 158 after the FET 157 is cut off) becomes short, and the light emission efficiency of the LED module improves.

Figure 19:
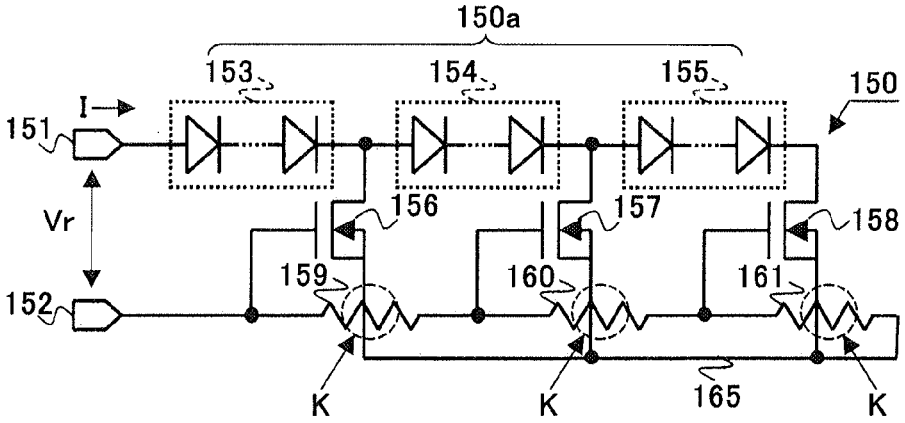
FIG. 19 is a circuit diagram explicitly showing jumper connections implemented by resistors in the circuit diagram of FIG. 18.

FIG. 19 is a circuit diagram explicitly showing the jumper connections implemented by the resistors in the circuit diagram of FIG. 18.

In FIG. 19, the places indicated by arrow K are the places where the resistors 159, 160, and 161 are placed so as to run over the common interconnect line 165 connecting to the sources of the respective FETs 156, 157, and 158. In practice, however, wires or the like are not routed so as to jump over the interconnect line 165, but the interconnects are made to run over the interconnect line 165 by using the resistors 159 to 161 as relay chips. Accordingly, there are no electrical connections between the interconnect line 165 and the resistors 159, 160, and 161.

Stated another way, the circuit diagram of FIG. 18 suggests that jumper connections need be made using wires or the like, because the interconnect line 165 crosses the gate interconnect lines. On the other hand, the circuit diagram of FIG. 19 indicates that there is no need to make jumper connections by using wires or the like to jump over the interconnect line 165, because the interconnect line 165 does not cross other interconnect lines but crosses the resistors 159, 160, and 161.

FIG. 20 is a diagram for explaining how the devices and wiring lines are arranged on the LED module 150.

FIG. 20 shows the portion in the circuit of FIG. 19 that concerns the FET 157 and the resistor 160. The point here is that the resistor 160 that divides the voltage developed across the current detecting resistor 162 is die-bonded (mounted) on the interconnect line 165 connected to the sources of the respective FETs 156 to 158. The resistor 160 is constructed by forming a resistive element of TaN film on a silicon substrate, and the resistive element is insulated from the silicon substrate. The resistor 160 has wire bonding pads 160*a*, 160*b*, and 160*c* on its upper surface.

In FIG. 20, the module substrate 173 is formed from a ceramic material, and interconnect lines 163, 164, 165, 166, 167, etc., are formed on its upper surface. The interconnect line 163 is on the high-voltage side relative to the resistor 160, and is connected to the wire bonding pad 160*a* on the resistor 160 via a wire 169 as well as to the resistor 161 shown in FIG. 19. The interconnect line 164 is on the low-voltage side relative to the resistor 160, and is connected to the wire bonding pad 160*b* on the resistor 160 via a wire 168 as well as to the resistor 159 shown in FIG. 19. The interconnect line 165 is the common interconnect line connected to the sources (wire bonding pad 157*b*, etc.,) of the respective FETs 156, 157, and 158 via a wire 172, etc., and the resistors 159, 160, and 161 are mounted on the upper surface of the interconnect line 165. The interconnect line 166 is a relaying interconnect pattern connected to the low-voltage side (wire bonding pad 160*c*) of the resistor 160 via a wire 170 and also connected to the gate (wire bonding pad 157*a*) of the FET 157 via a wire 171. The interconnect line 167 is an interconnect line for connecting to the drain of the FET 157 and for mounting the FET 157 on its upper surface, and is connected to the cathode of the LED sub-array 154 and the anode of the LED sub-array 155. The bottom face of the FET 157 is the drain terminal.

As shown in FIG. 20, the resistor 160 for dividing the voltage developed across the current detecting resistor 162 is placed on the common interconnect line 165 to which the source of the FET 157 is connected. The wiring bonding pad 160*a* on the resistor 160 is connected to the high-voltage side interconnect line 163 via the wire 169, the wiring bonding pad 160*b* is connected to the low-voltage side interconnect line 164 via the wire 168, and the wiring bonding pad 160*c* is connected via the wire 170 to the interconnect line 166 which is connected to the gate of the depletion-mode FET 157. As a result, there is no need to route wires so as to run over the common interconnect line 165 to which the source of the depletion-mode FET 157 is connected. In FIG. 20, only the interconnect structure between the resistor 160 and the common interconnect line 165 is shown, but the interconnect structure between the resistor 159 and the common interconnect line 165 and the interconnect structure between the resistor 161 and the common interconnect line 165 can also be made so that there is no need to route wires so as to run over the common interconnect line 165. The absence of jumper wires serves to prevent short-circuiting between such jumper wire and the interconnect line 165 on the module substrate 173. This improves insulation. If wire length is not limited, the resistor 160 may be connected to the gate of the FET 157 directly by a wire without the intervention of the interconnect line 166.

In the LED module 150, the source-to-drain current of each of the depletion-mode FETs 156 to 158 is controlled by a voltage divided across the current detecting resistor 162. Further, in the LED module 150, the voltage dividing resistors 159 to 161 constituting the current detecting resistor 162 are arranged on the common interconnect line 165 connecting to the sources of the respective FETs 156 to 158, thereby eliminating the need to route wires so as to run over the interconnect line 165. This eliminates the need for additional processing for insulation for the common source interconnect line 165. Furthermore, since the voltage dividing resistors 160, etc., also serve as the relay chips for wiring bonding, the number of components does not increase, and thus the LED module 150 lends itself to compact design. A relay chip refers to a chip that is used for relaying when a wire becomes too long.

Figure 21:
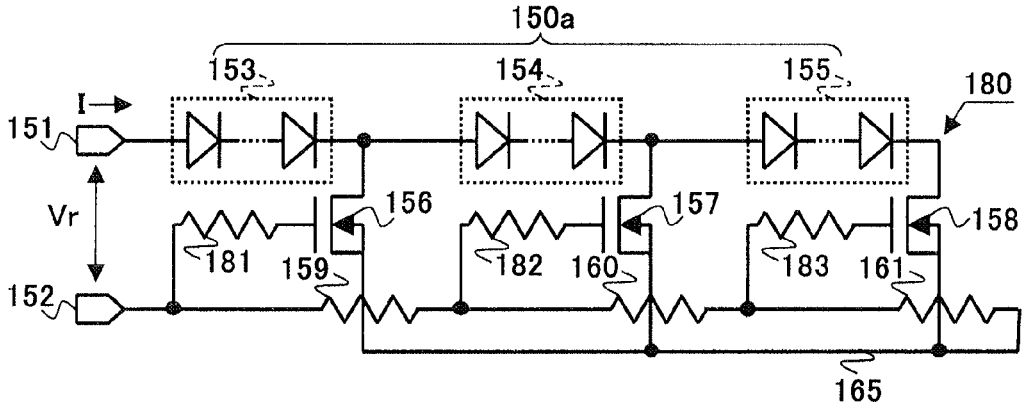
FIG. 21 is a circuit diagram showing an alternative LED module 180.

FIG. 21 is a circuit diagram showing an alternative LED module 180.

In the LED module 150 shown in FIG. 18, the gate of each of the FETs 156 to 158 is connected to one end of a corresponding one of the resistors 159 to 161 constituting the current detecting resistor 162. Since the resistors 159 to 161 are relatively low-value resistors each on the order of tens of ohms, surges, etc., intruding through the terminal 152 may not be sufficiently attenuated, and the gates of the FETs 156 to 158 may be damaged. The LED module 180 hereinafter described is equipped with gate protection resistors.

The only difference between the LED module 180 shown in FIG. 21 and the LED module 150 shown in FIG. 18 is that gate protection resistors 181, 182, and 183 are added to protect the gates of the FETs 156 to 158. Resistors with low precision can be used as the gate protection resistors 181 to 183, and each resistor need only be chosen to have a resistance in the range of tens to hundreds of kilo ohms. Since the voltage dividing resistors 159 to 161 are used in pairs with the gate protection resistors 181 to 183, these resistors can be networked. Networking resistors means forming a plurality of resistive elements within a single resistor chip and connecting them together in a desired relationship.

As shown in FIG. 20, in the case of the resistor 160 contained in the LED module 150, a resistive component is interposed between the terminal connected to the high-voltage side interconnect line 163 and the terminal connected to the low-voltage side interconnect line 164, and the terminal connected to the interconnect line 164 is shorted to the terminal connected to the interconnect line 166. On the other hand, when networking the resistors 160 and 182 in the LED module 180, the resistors should be formed in the following manner. That is, one resistive component (resistor 160) is formed between the terminal connected to the high-voltage side interconnect line 163 and the terminal connected to the low-voltage side interconnect line 164, and the other resistive component (resistor 182) is formed between the terminal connected to the interconnect line 164 and the terminal connected to the interconnect line 166.

As described above, in the LED module 180, the gates of the respective FETs 156 to 158 are protected, while avoiding an increase in the number of components by networking the voltage dividing resistors 159 to 161 and the gate protection resistors 181 to 183 in pairs.

Figure 22:
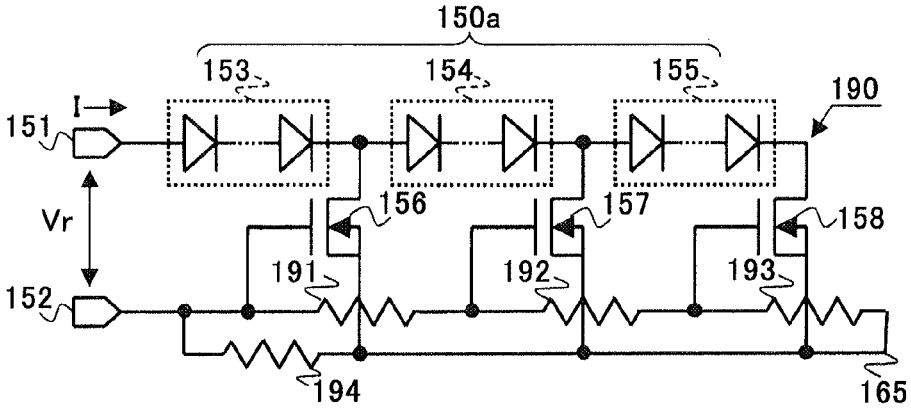
FIG. 22 is a circuit diagram showing another alternative LED module 190.

FIG. 22 is a circuit diagram showing another alternative LED module 190.

In the above-described LED modules 150 and 180, the current detecting resistor 162 is formed from a series circuit of the plurality of resistors 159 to 161, and the FETs 156 to 158 are each controlled by a voltage divided across the current detecting resistor 162. Since the FETs 156 to 158 in the LED modules 150 and 180 can each be controlled by a voltage, high-value resistors can be used as the voltage dividing resistors if the voltage need only be divided. In the LED module 190 described hereinafter, high-value resistors are used as the resistors for dividing the voltage developed across the current detecting resistor.

The LED module 190 shown in FIG. 22 differs from the LED module 150 shown in FIG. 18 in that, in the LED module 190, the current detecting resistor 194 is provided separately from the resistors 191, 192, and 193 provided to divide the voltage developed across the current detecting resistor 194. Since the FETs 156 to 158 are controlled by their gate voltages, the combined resistance of the voltage dividing resistors 191 to 193 need only be large enough not to affect the current detecting resistor 194. The voltage dividing resistors 191 to 193 may be set to have the same value.

As shown in FIG. 22 (and as in FIG. 19), in the LED module 190, the interconnect lines do not cross each other. That is, in the LED module 190, as in the LED modules 150 and 180, since the resistors 191, 192, and 193 are placed so as to run over the common interconnect lines connecting to the sources of the respective FETs 156 to 158, there is no need to make jumper connections by using wires to jump over the interconnect line 165. In the LED module 190, compared with the LED module 150, the number of components increases due to the addition of the current detecting resistor 194, but since the circuit current I can be varied by the value of the current detecting resistor 194, the amount of light emission can be easily adjusted.

In the LED modules 150, 180, and 190, the LED array 150*a* is constructed from three LED sub-arrays 153 to 155. However, the number of LED sub-arrays constituting the LED array need not be limited to three, but may be two or more than three. Further, as shown in FIG. 20, the resistor 160 is provided with the wire bonding pad 160*b* for connecting to the low-voltage side interconnect line 164 and the wire bonding pad 160*c* for connecting to the gate of the FET 157. However, in the LED module 150, since these wire bonding pads are at the same potential, these wire bonding pads may be combined into one wire bonding pad.

Figure 23:
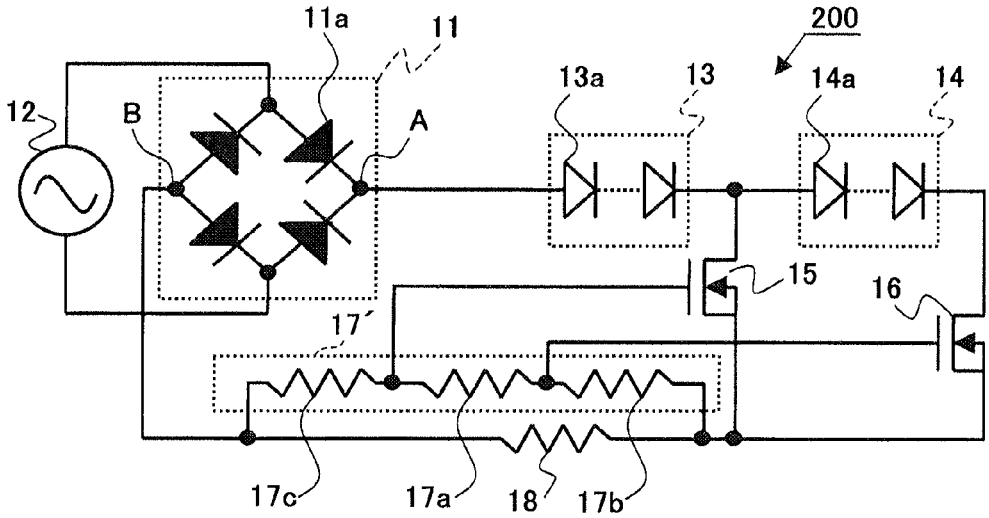
FIG. 23 is a circuit diagram of a yet even further alternative LED drive circuit 200.

FIG. 23 is a circuit diagram of a yet even further alternative LED drive circuit 200.

The LED drive circuit 200 shown in FIG. 23 is a modified example of the LED drive circuit 10 shown in FIG. 1. The same component elements are designated by the same reference numerals, and the description of such component elements will not be repeated herein. The only difference between the LED drive circuit 200 shown in FIG. 23 and the LED drive circuit 10 shown in FIG. 1 is that the voltage dividing circuit 17' in the LED drive circuit 200 includes a resistor 17*c* in addition to the resistors 17*a* and 17*b*.

In the LED drive circuit 200 which further includes the resistor 17*c*, the FET 15 (corresponding to the current limiting device forming the bypass circuit) is controlled by a voltage obtained by dividing the voltage developed across the current detecting resistor 18. This serves to delay the cutoff timing of the FET 15 in the period during which the voltage of the full-wave rectified waveform rises, and thereby serves to smooth the transition from the state in which the current I flows through the LED sub-array 13 and thence through the FET 15 to the state in which the current I flows through the LED sub-arrays 13 and 14 and thence through the FET 16. In addition to the functions of the LED drive circuit 10 shown in FIG. 1, the LED drive circuit 200 has the advantage of being able to further reduce high frequency noise because of the smooth transition from one electric current state to another.

Figure 24:
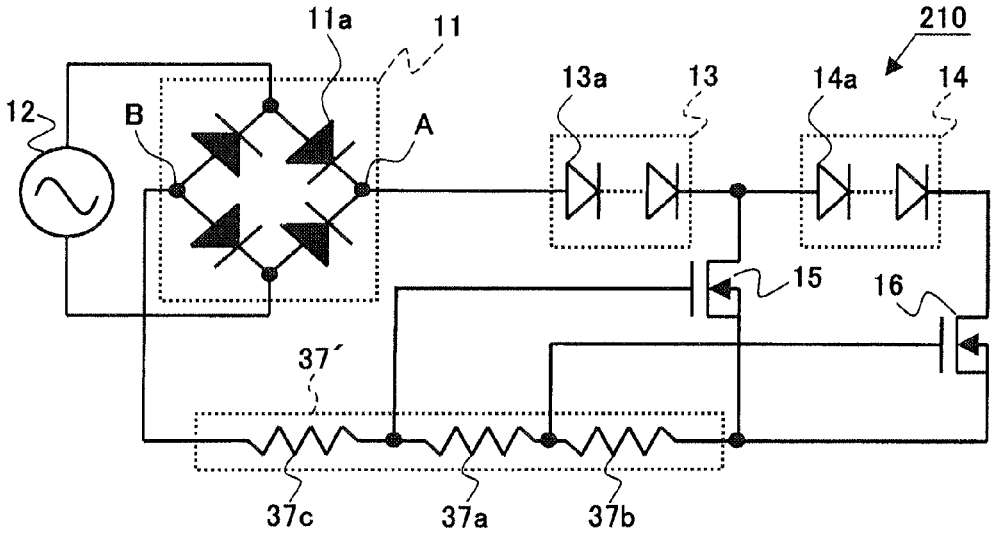
FIG. 24 is a circuit diagram of a still yet even further alternative LED drive circuit 210.

FIG. 24 is a circuit diagram of a still yet even further alternative LED drive circuit 210.

The LED drive circuit 210 shown in FIG. 24 is a modified example of the LED drive circuit 30 shown in FIG. 3. The same component elements are designated by the same reference numerals, and the description of such component elements will not be repeated herein. The only difference between the LED drive circuit 210 shown in FIG. 24 and the LED drive circuit 30 shown in FIG. 3 is that the voltage dividing circuit 37' in the LED drive circuit 210 includes a resistor 37*c* in addition to the resistors 37*a* and 37*b*.

In the LED drive circuit 210 which further includes the resistor 37*c*, the FET 15 (corresponding to the current limiting device forming the bypass circuit) is controlled by a voltage obtained by dividing the voltage developed across the current detecting resistor formed by the resistors 37*a*, 37*b*, and 37*c*. This serves to delay the cutoff timing of the FET 15 in the period during which the voltage of the full-wave rectified waveform rises, and thereby serves to smooth the transition from the state in which the current I flows through the LED sub-array 13 and thence through the FET 15 to the state in which the current I flows through the LED sub-arrays 13 and 14 and thence through the FET 16. In addition to the functions of the LED drive circuit 30 shown in FIG. 3, the LED drive circuit 210 has the advantage of being able to further reduce high frequency noise because of the smooth transition from one electric current state to another.

DESCRIPTION OF THE REFERENCE NUMERALS

10, 30, 40, 50, 60, 70, 80, 90, 100, 110, 120, 130, 140, 200, 210 . . . LED DRIVE CIRCUIT
11 . . . BRIDGE RECTIFIER
12 . . . COMMERCIAL AC POWER SUPPLY
12*a* . . . WALL SWITCH
13, 14, 41, 42, 43, 44, 111, 112, 113, 153, 154, 155 . . . LED SUB-ARRAY
13*a*, 14*a*, 41*a*, 42*a*, 43*a*, 44*a*, 111*a*, 112*a*, 113*a* . . . LED
15, 16, 45*a*, 45*b*, 45*c*, 45*d*, 114, 115, 116, 135, 156, 157, 158 . . . FET (DEPLETION-MODE FET)
17, 37, 47, 67 . . . VOLTAGE DIVIDING CIRCUIT
18, 48, 68, 83*a*, 84*a*, 97*a*, 98*a*, 107*a*, 108*a*, 118*a*, 118*b*, 162, 194 . . . CURRENT DETECTING RESISTOR
51, 53, 93, 94, 141 . . . VOLTAGE CONVERSION CIRCUIT
52, 54, 95, 96, 145 . . . FET (ENHANCEMENT-MODE FET)
71 . . . BYPASS CIRCUIT
72 . . . CURRENT LIMITING CIRCUIT
85, 129 . . . CONTROL CIRCUIT
128 . . . VOLUME
131*b*, 137 . . . THERMISTOR
134, 134', 144 . . . CONSTANT-CURRENT CIRCUIT
150, 180, 190 . . . LED MODULE
157*a*, 157*b*, 160*a*, 160*b*, 160*c* . . . WIRE BONDING PAD
173 . . . MODULE SUBSTRATE

What is claimed is:

1. An LED drive circuit in which the number of LEDs driven to emit light varies according to a commercial AC power supply voltage, comprising:

an LED array constructed by connecting a plurality of LEDs in series;

a current detecting resistor for detecting a current flowing through said LED array;

a bypass circuit connected to an intermediate connection point along said LED array; and a current limiting circuit connected to an end point of said LED array, wherein said bypass circuit includes a first current limiting device, said current limiting circuit includes a second current limiting device, and said first current limiting device is controlled based on a voltage developed across said current detecting resistor or a voltage obtained by dividing the voltage developed across said current detecting resistor, and said second current limiting device is controlled by a divided voltage obtained by voltage-dividing said current detecting resistor.

2. The LED drive circuit according to claim 1, wherein said bypass circuit or said current limiting circuit includes a voltage conversion circuit.

3. The LED drive circuit according to claim 2, wherein said voltage conversion circuit controls said first current limiting device or said second current limiting device by converting the voltage developed across said current detecting resistor or the voltage obtained by dividing said developed voltage.

4. The LED drive circuit according to claim 2, wherein said voltage conversion circuit includes a bipolar transistor, and the voltage developed across said current detecting resistor or the voltage obtained by dividing said developed voltage is input to an emitter of said bipolar transistor.

5. The LED drive circuit according to claim 2, wherein said first current limiting device and said second current limiting device are enhancement-mode FETs.

6. The LED drive circuit according to claim 1, wherein said first current limiting device and said second current limiting device are depletion-mode FETs, and said second current limiting device is controlled by the divided voltage obtained by voltage-dividing said current detecting resistor.

7. The LED drive circuit according to claim 2, further comprising a second bypass circuit connected to another intermediate connection point along said LED array, and wherein said second bypass circuit includes a third current limiting device, said third current limiting device are depletion-mode FETs and said third current limiting device is controlled by another divided voltage obtained by voltage-dividing said current detecting resistor.

8. The LED drive circuit according to claim 6, wherein said current detecting resistor includes a plurality of resistors and at least one of said plurality of resistors is a thermistor.

9. The LED drive circuit according to claim 6, further comprising an interconnect line which connects said current detecting resistor with a source of said first current limiting device and a source of said second current limiting device, wherein said current detecting resistor includes a plurality of resistors and at least one of said plurality of resistors is disposed on said interconnect line.

10. The LED drive circuit according to claim 6, further comprising a control circuit which causes a resistance value of said current detecting resistor to vary, and wherein light output control is performed by using said control circuit.

11. The LED drive circuit according to claim 10, further comprising a plurality of series circuits each constructed by connecting a switching device and a resistor in series, and wherein said series circuits are connected in parallel with each other, and said control circuit causes the resistance value of said current detecting resistor to vary by controlling said switching device.

12. The LED drive circuit according to claim 10, wherein said current detecting resistor is a device whose resistance value can be varied by a voltage applied to a control terminal.

* * * * *